US011386852B2

(12) United States Patent
Park et al.

(10) Patent No.: US 11,386,852 B2
(45) Date of Patent: Jul. 12, 2022

(54) DISPLAY DEVICE PERFORMING MULTI-FREQUENCY DRIVING

(71) Applicant: Samsung Display Co., Ltd., Yongin-si (KR)

(72) Inventors: Sehyuk Park, Seongnam-si (KR); Joon-Chul Goh, Suwon-si (KR); Sangan Kwon, Cheonan-si (KR); HongSoo Kim, Hwaseong-si (KR); Hui Nam, Suwon-si (KR); Jinyoung Roh, Hwaseong-si (KR); Hyojin Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/922,906

(22) Filed: Jul. 7, 2020

(65) Prior Publication Data

US 2021/0027720 A1 Jan. 28, 2021

(30) Foreign Application Priority Data

Jul. 26, 2019 (KR) ..... 10-2019-0090795

(51) Int. Cl.

| | |
|---|---|
| ***G09G 3/36*** | (2006.01) |
| ***G09G 3/3291*** | (2016.01) |
| ***G09G 3/3266*** | (2016.01) |

(52) U.S. Cl.

CPC ..... *G09G 3/3291* (2013.01); *G09G 3/3266* (2013.01); *G09G 2310/08* (2013.01); *G09G 2380/02* (2013.01)

(58) Field of Classification Search

CPC ... G09G 2300/0819; G09G 2300/0842; G09G 2300/0861; G09G 2310/0262; G09G 2310/08; G09G 2320/0233; G09G 2320/0247; G09G 2320/045; G09G 2320/103; G09G 2340/0435; G09G 2380/02; G09G 3/035; G09G 3/3291;

(Continued)

(56) References Cited

U.S. PATENT DOCUMENTS 9,524,694 B2 * 12/2016 Wang ..... G09G 5/391
2008/0284702 A1 * 11/2008 Shidara ..... G09G 3/20 345/90

(Continued)

FOREIGN PATENT DOCUMENTS

KR 10-2017-0005210 A 1/2017
KR 10-2017-0060662 A 6/2017
KR 10-2019-0003334 A 1/2019

*Primary Examiner* — Duc Q Dinh
(74) *Attorney, Agent, or Firm* — Lewis Roca Rothgerber Christie LLP

(57) ABSTRACT

A display device includes a display panel including a first partial panel region and a second partial panel region, and a panel driver configured to drive the display panel. The panel driver determines a first driving frequency for the first partial panel region and a second driving frequency for the second partial panel region. When the first driving frequency and the second driving frequency are different from each other, the panel driver sets a boundary portion including a boundary between the first partial panel region and the second partial panel region, and determines a third driving frequency for the boundary portion to be between the first driving frequency and the second driving frequency.

20 Claims, 17 Drawing Sheets

(58) Field of Classification Search
CPC ..... G09G 2300/0426; G09G 2310/04; G09G 2320/10; G09G 2310/0205; G06F 2203/04102; G06F 3/0482; G06F 3/0488
See application file for complete search history.

(56) References Cited

U.S. PATENT DOCUMENTS

| | | | | |
|---|---|---|---|---|
| 2011/0032231 | A1* | 2/2011 | Maruyama | G09G 3/2096 345/208 |
| 2014/0320479 | A1* | 10/2014 | Kaneko | G09G 3/3688 345/212 |
| 2017/0116946 | A1* | 4/2017 | Nakatani | G09G 3/3677 |
| 2017/0372681 | A1* | 12/2017 | Imai | G06F 3/1462 |
| 2019/0033919 | A1* | 1/2019 | Hirakata | G06F 3/041 |
| 2020/0098312 | A1* | 3/2020 | Cho | G09G 3/3225 |

* cited by examiner

| SL | BRF | LRF | DF3 |
|---|---|---|---|
| SL1281 | 60Hz | 0Hz | 60Hz |
| SL1282 | 40Hz | −10Hz | 30Hz |
| SL1283 | 30Hz | +10Hz | 40Hz |
| SL1284 | 24Hz | −9Hz | 15Hz |
| SL1285 | 20Hz | +4Hz | 24Hz |
| SL1286 | 15Hz | −9Hz | 6Hz |
| SL1287 | 12Hz | +3Hz | 15Hz |
| SL1288 | 6Hz | −4Hz | 2Hz |
| SL1289 | 3Hz | +1Hz | 4Hz |
| SL1290 | 2Hz | 0Hz | 2Hz |

DISPLAY DEVICE PERFORMING MULTI-FREQUENCY DRIVING

CROSS-REFERENCE TO RELATED APPLICATION

This application claims priority to and the benefit of Korean Patent Application No. 10-2019-0090795, filed on Jul. 26, 2019 in the Korean Intellectual Property Office (KIPO), the entire content of which is incorporated herein in its entirety by reference.

BACKGROUND

1. Field

Example embodiments of the present disclosure relate to a display device, and more particularly to a display device that performs multi-frequency driving (MFD).

2. Description of the Related Art

Reduction of power consumption is desirable in a display device employed in a portable device, such as a smartphone, a tablet computer, etc. Recently, in order to reduce the power consumption of the display device, a low frequency driving technique (which drives or refreshes a display panel at a frequency lower than an input frame frequency of input image data) has been developed.

However, in a related art display device to which the low frequency driving technique is applied, when a still image is not displayed in an entire region of a display panel, or when the still image is displayed only in a partial region (e.g., a portion) of the display panel, the entire region of the display panel is driven at a driving frequency substantially the same as the input frame frequency. Thus, in this case, the low frequency driving may not be performed, and the power consumption may not be reduced.

SUMMARY

An aspect according to some example embodiments is directed toward a display device capable of reducing power consumption by performing multi-frequency driving (MFD) that drives partial panel regions at different driving frequencies and preventing or substantially preventing a frequency change (e.g., a frequency difference) between the partial panel regions from being perceived (e.g., by the user).

According to example embodiments, a display device includes a display panel including a first partial panel region and a second partial panel region, and a panel driver to drive the display panel. The panel driver is to further determine a first driving frequency for the first partial panel region and a second driving frequency for the second partial panel region. When the first driving frequency and the second driving frequency are different from each other, the panel driver is to further set a boundary portion including a boundary between the first partial panel region and the second partial panel region, and to determine a third driving frequency for the boundary portion to be between the first driving frequency and the second driving frequency.

In example embodiments, the third driving frequency may gradually decrease in a direction from one of the first and second partial panel regions driven at a higher one of the first and second driving frequencies to the other one of the first and second partial panel regions driven at a lower one of the first and second driving frequencies.

In example embodiments, the third driving frequency may gradually decrease per scan line.

In example embodiments, the third driving frequency may gradually decrease per N scan lines, where N is an integer greater than 0, for example, equal to or greater than 1.

In example embodiments, a boundary reference frequency may be determined to be gradually decreased in a direction from one of the first and second partial panel regions driven at a higher one of the first and second driving frequencies to the other one of the first and second partial panel regions driven at a lower one of the first and second driving frequencies, a line random frequency may be determined randomly with respect to each of a plurality of scan lines included in the boundary portion, and the third driving frequency may be determined as a sum of the boundary reference frequency and the line random frequency.

In example embodiments, the display device may be a foldable display device, and the boundary between the first partial panel region and the second partial panel region may correspond to a folding line of the foldable display device.

In example embodiments, when a moving image is displayed in a portion of the display panel, and a still image is displayed in another portion of the display panel, the first partial panel region may be set as the portion of the display panel in which the moving image is displayed, the second partial panel region may be set as the other portion of the display panel in which the still image is displayed, and the boundary between the first partial panel region and the second partial panel region may be dynamically changed.

In example embodiments, a portion of one of the first and second partial panel regions driven at a lower one of the first and second driving frequencies may be set as the boundary portion.

In example embodiments, a number of scan lines included in the boundary portion may be set by (e.g., according to) a boundary portion size parameter.

In example embodiments, the third driving frequency for the boundary portion may be set by (e.g., according to) a boundary portion frequency parameter.

In example embodiments, the panel driver may include a still image detector to receive input image data at an input frame frequency, to divide the input image data into first partial image data for the first partial panel region and second partial image data for the second partial panel region, and to determine whether each of the first and second partial image data represent a still image.

In example embodiments, the still image detector may include a representative value memory to store a representative value of the first partial image data in a previous frame and a representative value of the second partial image data in the previous frame, and a still image detecting block to calculate a representative value of the first partial image data in a current frame and a representative value of the second partial image data in the current frame, to determine whether the first partial image data represent the still image by comparing the calculated representative value of the first partial image data and the representative value of the first partial image data stored in the representative value memory, and to determine whether the second partial image data represent the still image by comparing the calculated representative value of the second partial image data and the representative value of the second partial image data stored in the representative value memory.

In example embodiments, the panel driver may further include a driving frequency decider to determine the first driving frequency for the first partial panel region according to whether the first partial image data represent the still image, and to determine the second driving frequency for the second partial panel region according to whether the second partial image data represent the still image.

In example embodiments, the driving frequency decider may include a flicker lookup table to store flicker values corresponding to a plurality of gray levels of image data, and a driving frequency deciding block to set the first driving frequency at the input frame frequency when the first partial image data do not represent the still image, to decide a first flicker value corresponding to a gray level of the first partial image data by utilizing the flicker lookup table when the first partial image data represent the still image, to set the first driving frequency at a driving frequency corresponding to the first flicker value when the first partial image data represent the still image, to set the second driving frequency at the input frame frequency when the second partial image data do not represent the still image, to decide a second flicker value corresponding to a gray level of the second partial image data by utilizing the flicker lookup table when the second partial image data represent the still image, and to set the second driving frequency at a driving frequency corresponding to the second flicker value when the second partial image data represent the still image.

In example embodiments, the panel driver may further include a boundary portion setter to compare the first driving frequency and the second driving frequency, to set a portion of one of the first and second partial panel regions driven at a lower one of the first and second driving frequencies as the boundary portion, and to determine the third driving frequency for the boundary portion to be between the first driving frequency and the second driving frequency, a data output unit to output the first partial image data and the second partial image data except for boundary image data for the boundary portion at the first driving frequency and the second driving frequency, respectively, and to output the boundary image data for the boundary portion at the third driving frequency, and a data driver to provide data signals to the display panel based on the first partial image data, the second partial image data and the boundary image data output from the data output unit.

In example embodiments, the panel driver may include a scan driver to provide scan signals to the first partial panel region at the first driving frequency, to provide the scan signals to the second partial panel region at the second driving frequency, and to provide the scan signals to the boundary portion at the third driving frequency.

In example embodiments, the scan driver may include a plurality of stages to generate scan signals at an input frame frequency for a plurality of scan lines included in the display panel, and a plurality of logic gates respectively connected to the plurality of stages, and to selectively output the scan signals generated by the plurality of stages in response to a scan output masking signal, respectively, such that the scan signals are provided to the first partial panel region, the second partial panel region and the boundary portion at the first driving frequency, the second driving frequency and the third driving frequency, respectively.

In example embodiments, each of the first and second partial panel regions may include a plurality of pixels, and each of the plurality of pixels may include a driving transistor to generate a driving current, a switching transistor to transfer a data signal to a source of the driving transistor, a compensating transistor diode-connected with the driving transistor, a storage capacitor to store the data signal transferred through the switching transistor and the diode-connected driving transistor, a first initializing transistor to provide an initialization voltage to the storage capacitor and a gate electrode of the driving transistor, a first emission controlling transistor to connect a line of a power supply voltage to a source electrode of the driving transistor, a second emission controlling transistor to connect a drain electrode of the driving transistor to an organic light emitting diode, a second initializing transistor to provide the initialization voltage to the organic light emitting diode, and the organic light emitting diode to emit light based on the driving current. At least one transistor selected from the driving transistor, the switching transistor, the compensating transistor, the first initializing transistor, the first emission controlling transistor, the second emission controlling transistor and the second initializing transistor may be implemented with a PMOS transistor, and at least one transistor selected from a remaining one of the driving transistor, the switching transistor, the compensating transistor, the first initializing transistor, the first emission controlling transistor, the second emission controlling transistor and the second initializing transistor may be implemented with an NMOS transistor.

According to example embodiments, a display device includes a display panel including a plurality of partial panel regions, and a panel driver to drive the display panel. The panel driver is to further determine a plurality of driving frequencies for the plurality of partial panel regions, respectively. When the driving frequencies for two adjacent partial panel regions of the plurality of partial panel regions are different from each other, the panel driver is to further set a boundary portion including a boundary between the two adjacent partial panel regions, and to determine a driving frequency for the boundary portion to be between the driving frequencies for the two adjacent partial panel regions.

In example embodiments, the driving frequency for the boundary portion may gradually decrease in a direction from one of the two adjacent partial panel regions at a relatively higher driving frequency to the other one of the two adjacent partial panel regions at a relatively lower driving frequency.

As described above, in a case where a first driving frequency for a first partial panel region and a second driving frequency for a second partial panel region are different from each other, a display device according to example embodiments may determine a third driving frequency for a boundary portion including a boundary between the first partial panel region and the second partial panel region to be between the first driving frequency and the second driving frequency. Accordingly, even when the first and second partial panel regions are driven at the different driving frequencies, a frequency change between the first and second partial panel regions may not be perceived (e.g., by the user).

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, embodiments of the present disclosure will be explained in more detail with reference to the accompanying drawings.

Figure 1:
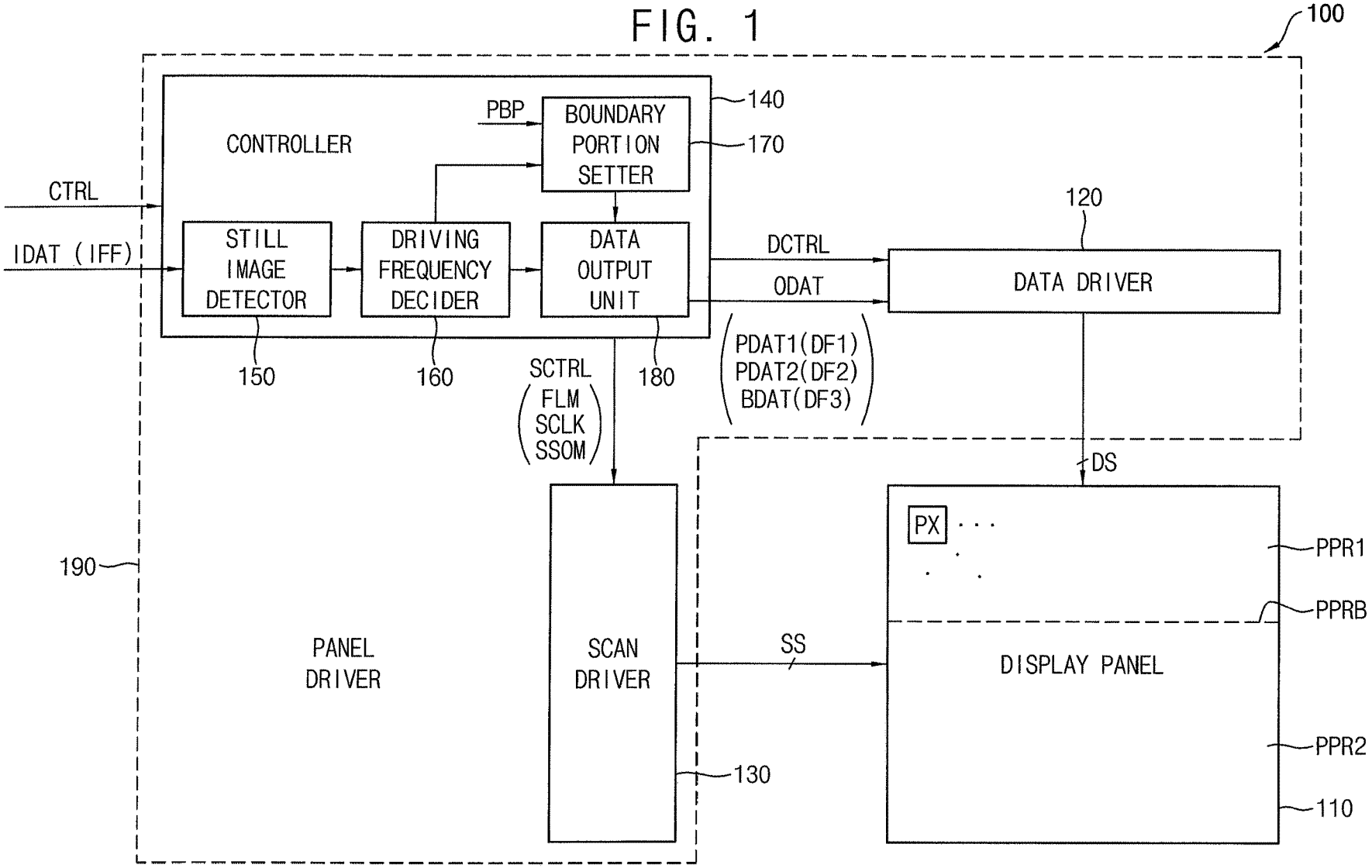
FIG. 1 is a block diagram illustrating a display device according to example embodiments.
Figure 2A:
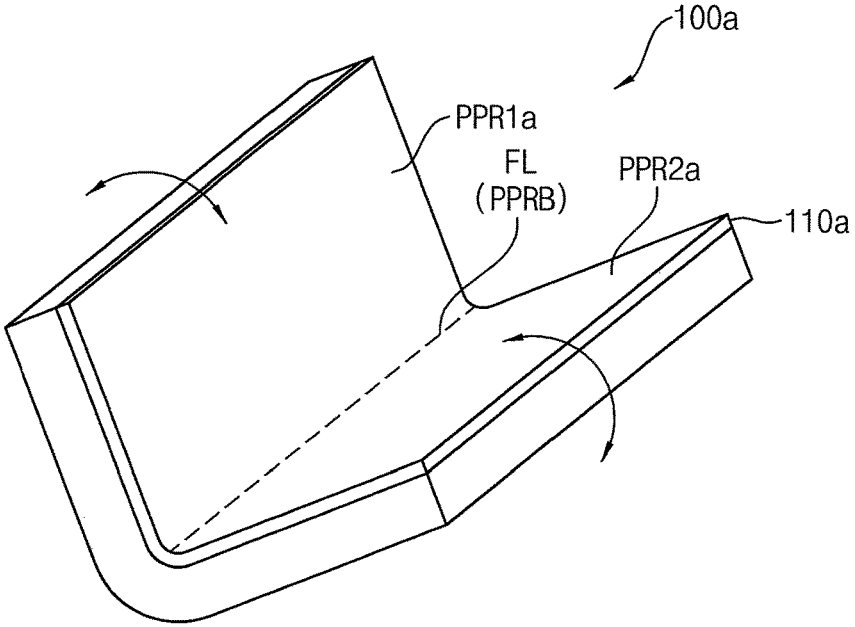
FIG. 2A is a diagram illustrating an example where a display device of FIG. 1 is an in-folding display device.
Figure 2B:
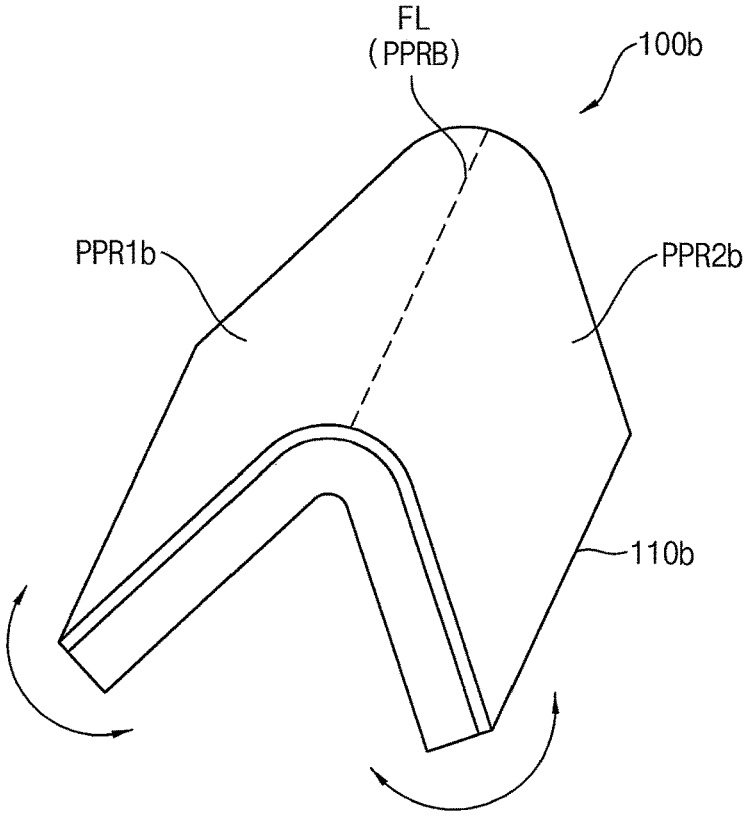
FIG. 2B is a diagram illustrating an example where a display device of FIG. 1 is an out-folding display device.
Figure 3:
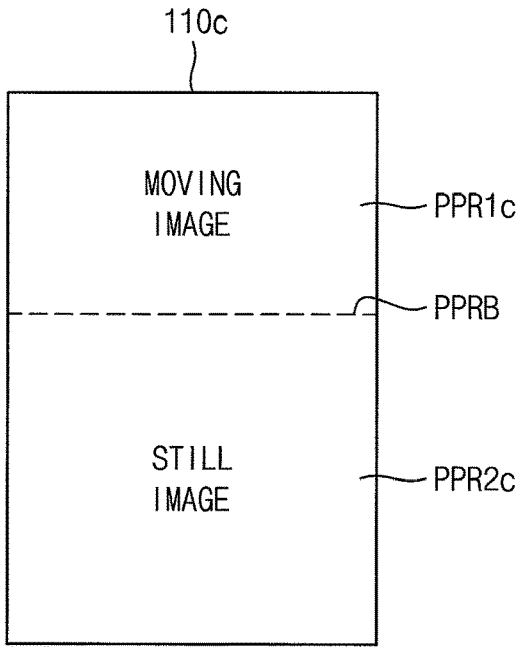
FIG. 3 is a diagram illustrating an example where a first partial panel region is set as a portion of a display panel in which a moving image is displayed and a second partial panel region is set as another portion of the display panel in which a still image is displayed.
Figure 4:
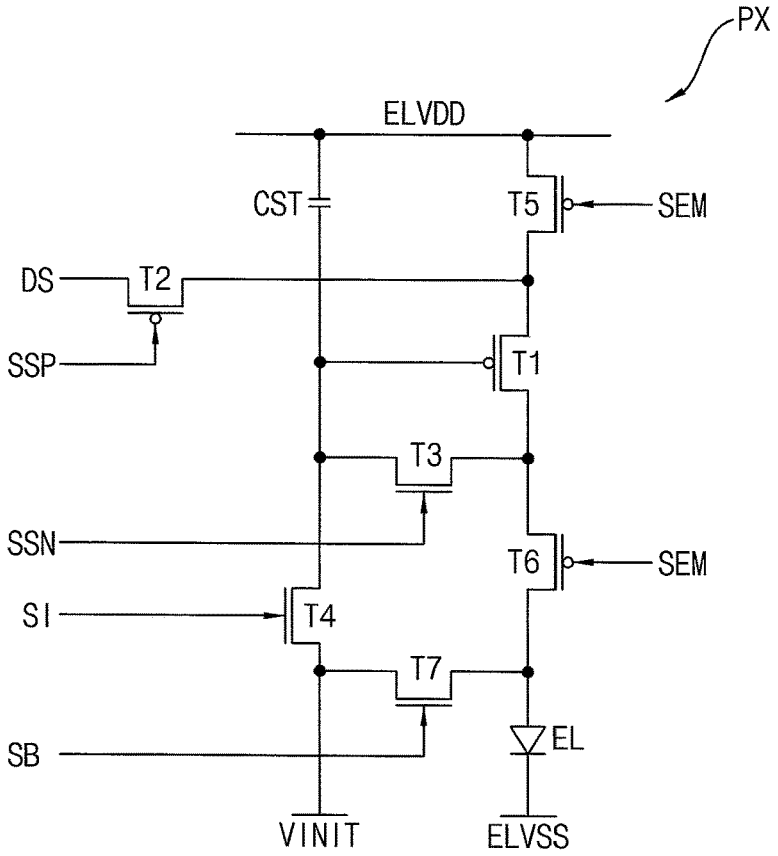
FIG. 4 is a circuit diagram illustrating an example of a pixel included in a display device according to example embodiments.
Figure 5:
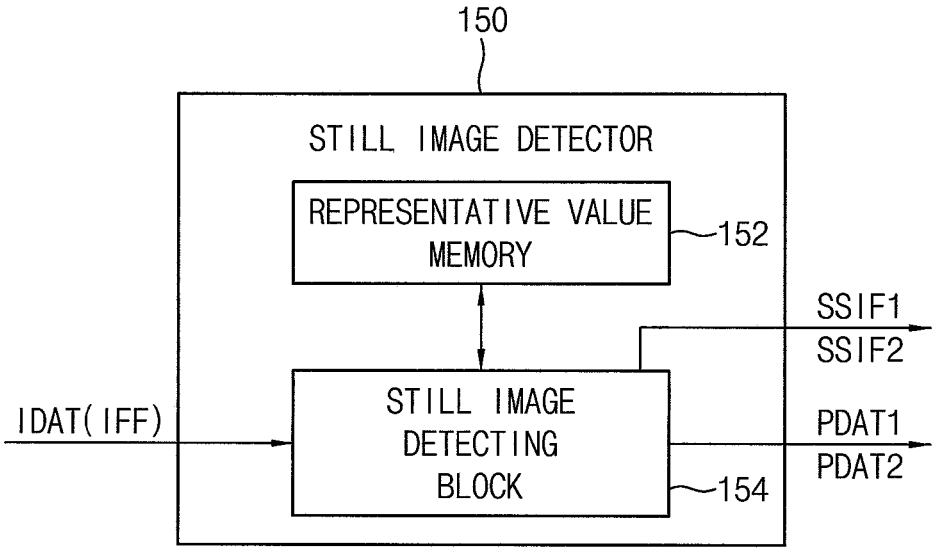
FIG. 5 is a block diagram illustrating an example of a still image detector included in a display device according to example embodiments.
Figure 6:
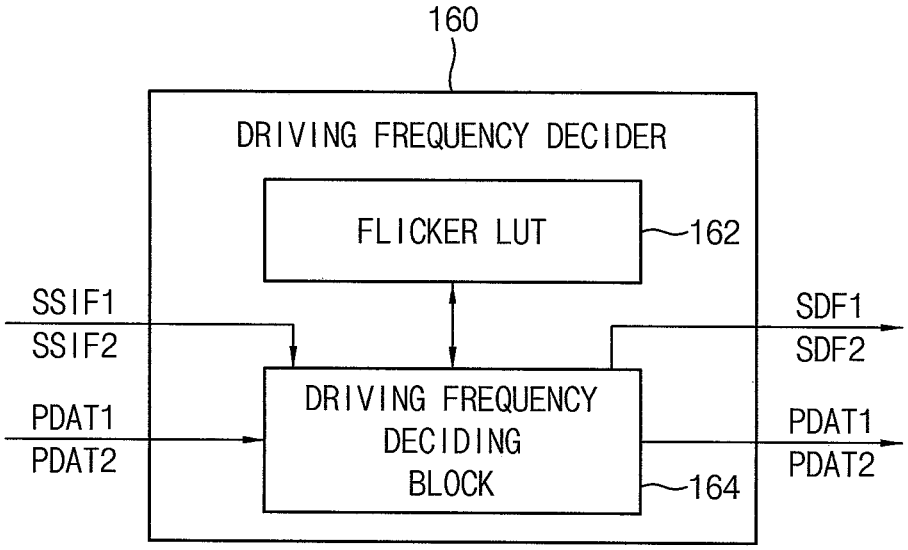
FIG. 6 is a block diagram illustrating an example of a driving frequency decider included in a display device according to example embodiments.
Figure 7:
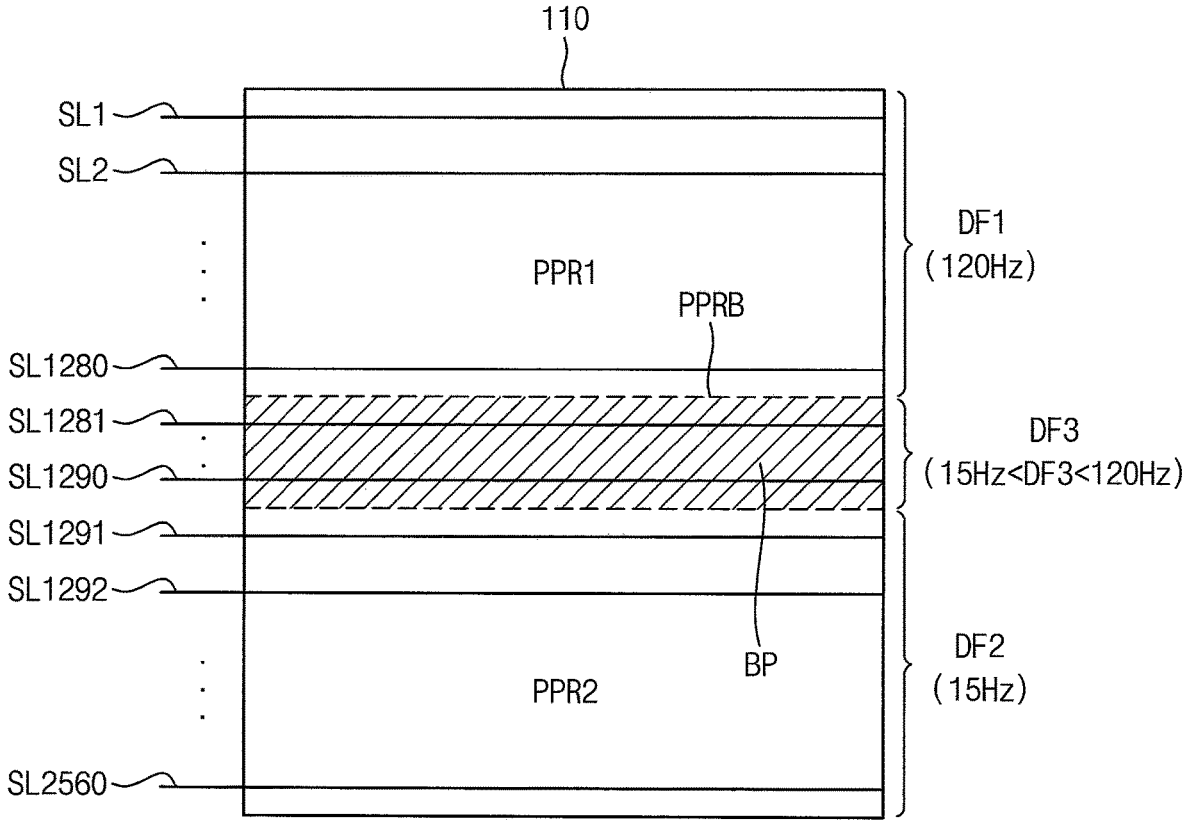
FIG. 7 is a diagram for describing an example where a boundary portion setter included in a display device sets a boundary portion according to example embodiments.
Figure 8:
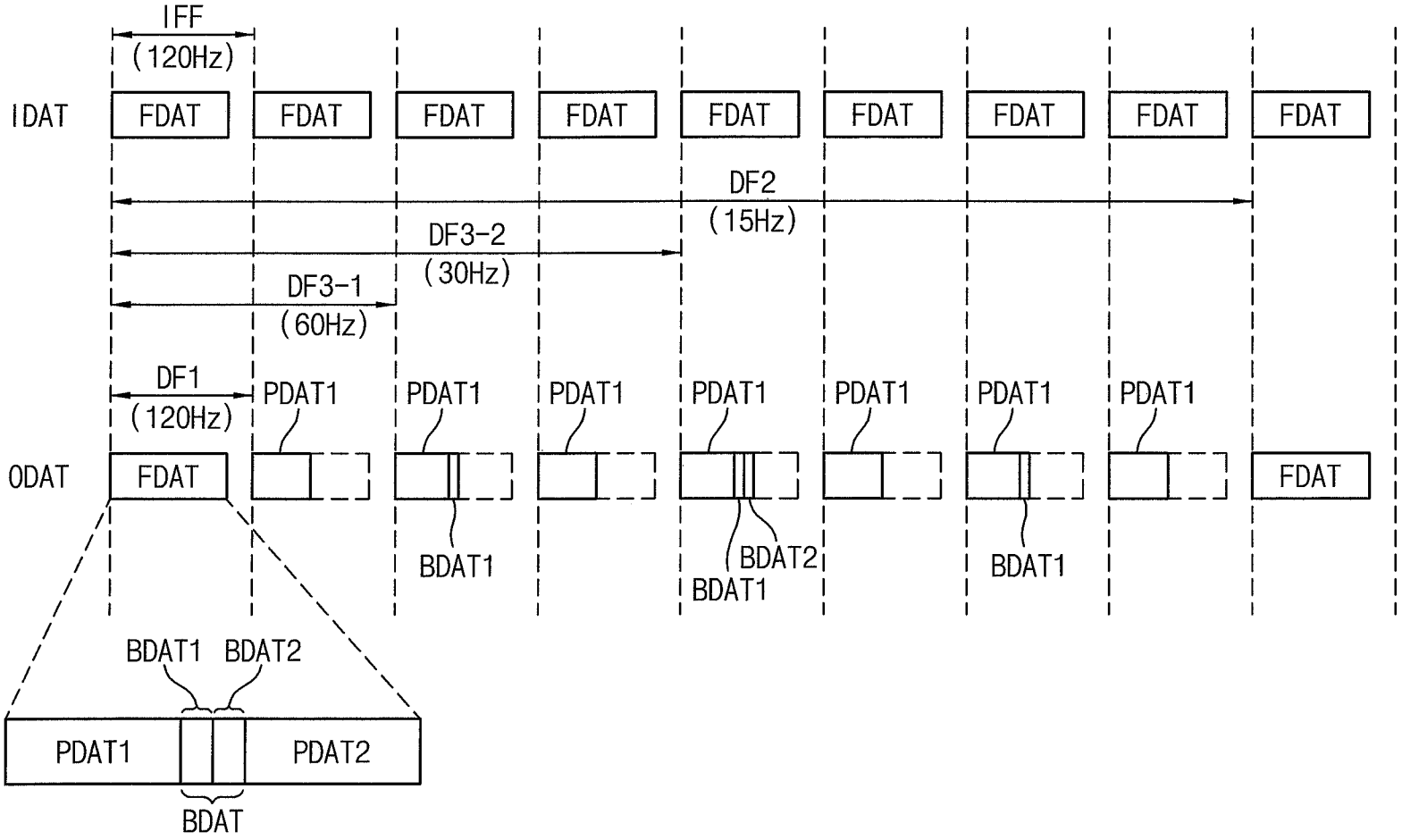
FIG. 8 is a diagram for describing an example where a data output unit included in a display device outputs first partial image data, second partial image data and boundary image data at different driving frequencies according to example embodiments.

FIG. 1 is a block diagram illustrating a display device according to example embodiments, FIG. 2A is a diagram illustrating an example where a display device of FIG. 1 is an in-folding display device, FIG. 2B is a diagram illustrating an example where a display device of FIG. 1 is an out-folding display device, FIG. 3 is a diagram illustrating an example where a first partial panel region is set as a portion of a display panel in which a moving image is displayed and a second partial panel region is set as another portion of the display panel in which a still image is displayed, FIG. 4 is a circuit diagram illustrating an example of a pixel included in a display device according to example embodiments, FIG. 5 is a block diagram illustrating an example of a still image detector included in a display device according to example embodiments, FIG. 6 is a block diagram illustrating an example of a driving frequency decider included in a display device according to example embodiments, FIG. 7 is a diagram for describing an example where a boundary portion setter included in a display device sets a boundary portion according to example embodiments, and FIG. 8 is a diagram for describing an example where a data output unit included in a display device outputs first partial image data, second partial image data and boundary image data at different driving frequencies according to example embodiments.

Referring to FIG. 1, a display device 100 according to example embodiments may include a display panel 110, and a panel driver 190 that drives the display panel 110. In some example embodiments, the panel driver 190 may include a data driver 120 that provides data signals DS to the display panel 110, a scan driver 130 that provides scan signals SS to the display panel 110, and a controller 140 that controls an operation of the display device 100.

The display panel 110 may include a first partial panel region (e.g., a first portion of the display panel) PPR1 and a second partial panel region (e.g., a second portion of the display panel) PPR2. For example, the display panel 110 may be divided into the first partial panel region PPR1 and the second partial panel region PPR2 such that each of the first and second partial panel regions PPR1 and PPR2 includes two or more scan lines, and/or two or more pixel rows connected to the two or more scan lines.

In some example embodiments, a boundary PPRB between the first partial panel region PPR1 and the second partial panel region PPR2 may have a fixed position within the display panel 110. For example, the display device 100 may be a foldable display device, and the boundary PPRB between the first partial panel region PPR1 and the second partial panel region PPR2 may correspond to a folding line of the foldable display device.

In an example, as illustrated in FIG. 2A, the display device 100 may be an in-folding display device 100*a* including an in-folding display panel 110*a* that is folded such that the first and second partial panel regions PPR1*a* and PPR2*a* face each other, and the boundary PPRB between the first and second partial panel regions PPR1*a* and PPR2*a* may have a fixed position corresponding to a folding line FL at which the in-folding display panel 110*a* is folded. In another example, as illustrated in FIG. 2B, the display device 100 may be an out-folding display device 100*b* including an out-folding display panel 110*b* that is folded such that one of the first and second partial panel regions PPR1*b* and PPR2*b* is located at a front side (e.g., facing the viewer) and the other one of the first and second partial panel regions PPR1*b* and PPR2*b* is located at a back side (e.g., facing away from the viewer), and the boundary PPRB between the first and second partial panel regions PPR1*b* and PPR2*b* may have a fixed position corresponding to a folding line FL at which the out-folding display panel 110*b* is folded. Although FIGS. 2A and 2B illustrate examples where the display device 100 may be the foldable display devices 100*a* and 100*b*, in some example embodiments, the display device 100 may be any suitable flexible display device, such as a curved display device, a bended (e.g., bendable) display device, a rollable display device, a stretchable display device, etc. In other example embodiments, the display device 100 may be a flat (e.g., rigid) display device.

In other example embodiments, the boundary PPRB between the first partial panel region PPR1 and the second partial panel region PPR2 may be dynamically changed. That is, the location of the boundary PPRB between the first partial panel region PPR1 and the second partial panel region PPR2 may change according to time. For example, as illustrated in FIG. 3, in a case where a moving image is displayed in a portion of the display panel 110*c*, and a still image is displayed in another portion of the display panel 110*c*, the first partial panel region PPR1*c* may be set as the portion of the display panel in which the moving image is displayed, the second partial panel region PPR2*c* may be set as the other portion of the display panel in which the still image is displayed, and thus the boundary PPRB between the first partial panel region PPR1*c* and the second partial panel region PPR2*c* may be set as a boundary between the moving image and the still image. In this case, when the boundary between the moving image and the still image is changed, the boundary PPRB between the first partial panel region PPR1*c* and the second partial panel region PPR2*c* also may be changed.

The display panel 110 may include a plurality of data lines, a plurality of scan lines, and a plurality of pixels PX connected to the plurality of data lines and the plurality of scan lines. Furthermore, each of the first partial panel region PPR1 and the second partial panel region PPR2 may include a plurality of pixels PX. In some example embodiments, each pixel PX may include at least one capacitor, at least two transistors and an organic light emitting diode (OLED), and the display panel 110 may be an OLED display panel. Further, in some example embodiments, each pixel PX may be a hybrid oxide polycrystalline (HOP) pixel suitable for low frequency driving capable of reducing power consumption. In the HOP pixel, at least one first transistor may be implemented with a low-temperature polycrystalline silicon (LTPS) p-type metal-oxide-semiconductor (PMOS) transistor, and at least one second transistor may be implemented with an oxide n-type metal-oxide-semiconductor (NMOS) transistor.

For example, as illustrated in FIG. 4, each pixel PX may include a driving transistor T1 that generates a driving current, a switching transistor T2 that transfers the data signal DS from the data driver 120 to a source (i.e., source electrode) of the driving transistor T1 in response to a first scan signal SSP from the scan driver 130, a compensating transistor T3 that diode-connects (e.g., that is diode-connected with) the driving transistor T1 in response to a second scan signal SSN from the scan driver 130, a storage capacitor CST that stores the data signal DS transferred through the switching transistor T2 and the diode-connected driving transistor T1, a first initializing transistor T4 that provides an initialization voltage VINIT to the storage capacitor CST and a gate (i.e., gate electrode) of the driving transistor T1 in response to a first initialization signal SI from the scan driver 130, a first emission controlling transistor T5 that connects a line of a high power supply voltage ELVDD to the source of the driving transistor T1 in response to an emission control signal SEM from an emission driver, a second emission controlling transistor T6 that connects a drain (i.e., drain electrode) of the driving transistor T1 to an organic light emitting diode EL in response to the emission control signal SEM from the emission driver, a second initializing transistor (or a bypass transistor) T7 that provides the initialization voltage VINIT to the organic light emitting diode EL in response to a second initialization signal (or a bypass signal) SB from the scan driver 130, and the organic light emitting diode EL that emits light based on the driving current from the line of the high power supply voltage ELVDD to a line of a low power supply voltage ELVSS.

At least first one of the driving transistor T1, the switching transistor T2, the compensating transistor T3, the first initializing transistor T4, the first emission controlling transistor T5, the second emission controlling transistor T6 and the second initializing transistor T7 may be implemented with a PMOS transistor, and at least second one of the driving transistor T1, the switching transistor T2, the compensating transistor T3, the first initializing transistor T4, the first emission controlling transistor T5, the second emission controlling transistor T6 and the second initializing transistor T7 may be implemented with an NMOS transistor. That is, at least one transistor selected from the driving transistor T1, the switching transistor T2, the compensating transistor T3, the first initializing transistor T4, the first emission controlling transistor T5, the second emission controlling transistor T6 and the second initializing transistor T7 may be implemented with a PMOS transistor, and at least one transistor selected from the remaining ones of these transistors may be implemented with an NMOS transistor. For example, as illustrated in FIG. 4, the compensating transistor T3, the first initializing transistor T4 and the second initializing transistor T7 may be implemented with the NMOS transistors, and other transistors T1, T2, T5 and T6 may be implemented with the PMOS transistors. In this case, the second scan signal SSN applied to the compensating transistor T3, the first initialization signal SI applied to the first initializing transistor T4 and the second initialization signal SB applied to the second initializing transistor T7 may be active-high signals suitable for the NMOS transistor. In this case, because the transistors T3 and T4 directly connected to the storage capacitor CST and the transistor T7 directly connected to the organic light emitting diode EL are implemented with the NMOS transistors, leakage currents from the storage capacitor CST and/or a parasitic capacitor of the organic light emitting diode EL may be reduced, and thus the pixel PX may be suitable for the low frequency driving. Although FIG. 4 illustrates an example where the compensating transistor T3, the first initializing transistor T4 and the second initializing transistor T7 are implemented with the NMOS transistors, a configuration of each pixel PX according to example embodiments is not limited to the example of FIG. 4. In other example embodiments, the display panel 110 may be a liquid crystal display (LCD) panel, and/or the like.

The data driver 120 may generate the data signals DS based on output image data ODAT and a data control signal DCTRL received from the controller 140, and may provide the data signals DS to the plurality of pixels PX through the plurality of data lines. In some example embodiments, the data control signal DCTRL may include, but not be limited to, an output data enable signal, a horizontal start signal and a load signal. In some example embodiments, the data driver 120 and the controller 140 may be implemented with a single integrated circuit, and the integrated circuit may be referred to as a timing controller embedded data driver (TED). In other example embodiments, the data driver 120 and the controller 140 may be implemented with separate integrated circuits.

The scan driver 130 may provide the scan signals SS to the plurality of pixels PX through the plurality of scan lines based on a scan control signal SCTRL received from the controller 140. In some example embodiments, the scan driver 130 may provide the scan signals SS to the plurality of pixels PX sequentially on a row-by-row basis. Further, in some example embodiments, the scan control signal SCTRL may include, but not be limited to, a scan start signal FLM, a scan clock signal SCLK and a scan output masking signal SSOM. In some example embodiments, the scan driver 130 may be integrated with or formed in a peripheral portion of the display panel 110. In other example embodiments, the scan driver 130 may be implemented with one or more integrated circuits.

The controller (e.g., a timing controller (TCON)) 140 may receive input image data IDAT and a control signal CTRL from an external host (e.g., a graphic processing unit (GPU) or a graphic card). In some example embodiments, the control signal CTRL may include, but not be limited to, a vertical synchronization signal, a horizontal synchronization signal, an input data enable signal, a master clock signal, etc. The controller 140 may generate the data control signal DCTRL, the scan control signal SCTRL and the output image data ODAT based on the control signal CTRL and the input image data IDAT. The controller 140 may control an operation of the data driver 120 by providing the output image data ODAT and the data control signal DCTRL to the data driver 120, and may control an operation of the scan driver 130 by providing the scan control signal SCTRL to the scan driver 130.

The panel driver 190 of the display device 100 according to example embodiments may perform multi-frequency driving (MFD) that drives the first partial panel region PPR1 and the second partial panel region PPR2 of the display panel 110 at different first and second driving frequencies DF1 and DF2 respectively. In a case where the first and second driving frequencies DF1 and DF2 for the first and second partial panel regions PPR1 and PPR2 are different from each other, the panel driver 190 may set a boundary portion including the boundary PPRB between the first and second partial panel regions PPR1 and PPR2, and may determine a third driving frequency DF3 for the boundary portion to be between the first driving frequency DF1 and the second driving frequency DF2. To perform these operations, in some example embodiments, the panel driver 190 may include a still image detector 150, a driving frequency decider 160, a boundary portion setter 170 and a data output unit 180. In some example embodiments, as illustrated in FIG. 1, the still image detector 150, the driving frequency decider 160, the boundary portion setter 170 and the data output unit 180 may be included in the controller 140. However, locations of the still image detector 150, the driving frequency decider 160, the boundary portion setter 170 and the data output unit 180 may not be limited to be inside the controller 140.

The still image detector 150 may receive the input image data IDAT at the input frame frequency IFF, may divide the input image data IDAT into first partial image data PDAT1 for the first partial panel region PPR1 and second partial image data PDAT2 for the second partial panel region PPR2, and may determine whether each of the first and second partial image data PDAT1 and PDAT2 represent a still image. In some example embodiments, the still image detector 150 may determine whether the first partial image data PDAT1 represent the still image by comparing the first partial image data PDAT1 in a previous frame with the first partial image data PDAT1 in a current frame, and may determine whether the second partial image data PDAT2 represent the still image by comparing the second partial image data PDAT2 in the previous frame with the second partial image data PDAT2 in the current frame.

For example, as illustrated in FIG. 5, the still image detector 150 may include a representative value memory 152 and a still image detecting block 154. The representative value memory 152 may store a representative value of the first partial image data PDAT1 in a previous frame and a representative value of the second partial image data PDAT2 in the previous frame. The still image detecting block 154 may calculate a representative value of the first partial image data PDAT1 in a current frame and a representative value of the second partial image data PDAT2 in the current frame, may determine whether the first partial image data PDAT1 represent the still image by comparing the calculated representative value of the first partial image data PDAT1 and the representative value of the first partial image data PDAT1 stored in the representative value memory 152, and may determine whether the second partial image data PDAT2 represent the still image by comparing the calculated representative value of the second partial image data PDAT2 and the representative value of the second partial image data PDAT2 stored in the representative value memory 152. The still image detecting block 154 may output the first partial image data PDAT1 and the second partial image data PDAT2 to the driving frequency decider 160, and may further output a first still image determination signal SSIF1 representing whether the first partial image data PDAT1 represent the still image and a second still image determination signal SSIF2 representing whether the second partial image data PDAT2 represent the still image. The still image detecting block 154 may store the calculated representative value of the first partial image data PDAT1 and the calculated representative value of the second partial image data PDAT2 in the current frame in the representative value memory 152 to be utilized in the next frame.

The driving frequency decider 160 may determine the first driving frequency DF1 for the first partial panel region PPR1 according to whether the first partial image data PDAT1 represent the still image, and may determine the second driving frequency DF2 for the second partial panel region PPR2 according to whether the second partial image data PDAT2 represent the still image. That is, the driving frequency decider 160 may set the first driving frequency DF1 for the first partial panel region PPR1 according to whether the first partial image data PDAT1 represent the still image, and may set the second driving frequency DF2 for the second partial panel region PPR2 according to whether the second partial image data PDAT2 represent the still image. In some example embodiments, the driving frequency decider 160 may determine the first driving frequency DF1 for the first partial panel region PPR1 as the input frame frequency IFF when the first partial image data PDAT1 do not represent the still image (and/or represent a moving image), and may determine the first driving frequency DF1 for the first partial panel region PPR1 as a frequency lower than the input frame frequency IFF when the first partial image data PDAT1 represent the still image. Further, the driving frequency decider 160 may determine the second driving frequency DF2 for the second partial panel region PPR2 as the input frame frequency IFF when the second partial image data PDAT2 do not represent the still image (and/or represent the moving image), and may determine the second driving frequency DF2 for the second partial panel region PPR2 as a frequency lower than the input frame frequency IFF when the second partial image data PDAT2 represent the still image. Further, in a case where each of the first and second partial image data PDAT1 and PDAT2 represent the still image, the driving frequency decider 160 may determine a flicker value according to a gray level (and/or luminance) of each of the first and second partial image data PDAT1 and PDAT2, and may determine the first and second driving frequencies DF1 and DF2 according to the flicker values.

For example, as illustrated in FIG. 6, the driving frequency decider 160 may include a flicker lookup table (LUT) 162 and a driving frequency deciding block 164. The flicker lookup table 162 may store flicker values corresponding to respective gray levels of image data. Here, the flicker value may represent a level of the flicker perceived by a user. The driving frequency deciding block 164 may determine (e.g., set) the first driving frequency DF1 as the input frame frequency IFF in response to the first still image determination signal SSIF1 representing that the first partial image data PDAT1 do not represent the still image. In response to the first still image determination signal SSIF1 representing that the first partial image data PDAT1 represent the still image, the driving frequency deciding block 164 may decide a first flicker value corresponding to a gray level of the first partial image data PDAT1 by utilizing the flicker lookup table 162, and may determine the first driving frequency DF1 as a driving frequency corresponding to the first flicker value. According to example embodiments, deciding the flicker value and determining the driving frequency may be performed on a pixel-by-pixel basis, a segment-by-segment basis, and/or a partial panel region-by-partial panel region basis. For example, the first partial image data PDAT1 may be divided into a plurality of segments, flicker values for the respective segments may be decided, driving frequencies for the respective segments may be determined, and the first driving frequency DF1 may be determined as the maximum one of the determined driving frequencies. That is, the first driving frequency DF1 may be set at the highest determined driving frequency from among the determined driving frequencies of the plurality of segments of the first partial image date PDAT1. Further, the driving frequency deciding block 164 may determine the second driving frequency DF2 as the input frame frequency IFF in response to the second still image determination signal SSIF2 representing that the second partial image data PDAT2 do not represent the still image. In response to the second still image determination signal SSIF2 representing that the second partial image data PDAT2 represent the still image, the driving frequency deciding block 164 may decide a second flicker value corresponding to a gray level of the second partial image data PDAT2 by utilizing the flicker lookup table 162, and may determine the second driving frequency DF2 as a driving frequency corresponding to the second flicker value. The driving frequency deciding block 164 may output the first partial image data PDAT1 and the second partial image data PDAT2, and may further output a first driving frequency signal SDF1 representing the first driving frequency DF1 for the first partial panel region PPR1 and a second driving frequency signal SDF2 representing the second driving frequency DF2 for the second partial panel region PPR2.

The boundary portion setter 170 may compare the first driving frequency DF1 represented by the first driving frequency signal SDF1 and the second driving frequency DF2 represented by the second driving frequency signal SDF2, may set a boundary portion including the boundary PPRB between the first partial panel region PPR1 and the second partial panel region PPR2 when the first driving frequency DF1 and the second driving frequency DF2 are different from each other, and may determine the third driving frequency DF3 for the boundary portion to be between the first driving frequency DF1 and the second driving frequency DF2. In some example embodiments, the boundary portion setter 170 may set a portion of one of the first and second partial panel regions PPR1 and PPR2 driven at a lower one of the first and second driving frequencies DF1 and DF2 as the boundary portion.

For example, as illustrated in FIG. 7, in a case where the first partial panel region PPR1 includes 1st through 1280th scan lines SL1, SL2, SL1280 (and/or 1280 pixel rows connected to the 1st through 1280th scan lines SL1, SL2, SL1280), the second partial panel region PPR2 includes 1281st through 2560th scan lines SL1281, . . . , SL1290, SL1291, SL1292, SL2560 (and/or 1280 pixel rows connected to the 1281st through 2560th scan lines SL1281, SL1290, SL1291, SL1292, SL2560), the first driving frequency DF1 for the first partial panel region PPR1 is about 120 Hz, and the second driving frequency DF2 for the second partial panel region PPR2 is about 15 Hz, the boundary portion setter 170 may set a portion of the second partial panel region PPR2 driven at the relatively lower second driving frequency DF2, for example, the 1281st through 1290th scan lines SL1281, SL1290 (and/or 10 pixel rows connected to the 1281st through 1290th scan lines SL1281, SL1290) as the boundary portion BP. The boundary portion setter 170 may determine the third driving frequency DF3 for the boundary portion BP to be higher than about 15 Hz and lower than about 120 Hz. Although FIG. 7 illustrates an example where the boundary portion BP includes 10 scan lines SL1281, SL1290, a size of the boundary portion BP, and/or the number of scan lines included in the boundary portion BP may not be limited to the example of FIG. 7. In some example embodiments, the size of the boundary portion BP, and/or the number of scan lines included in the boundary portion BP may be set or updated by a boundary portion parameter PBP. For example, the controller 140 may store, as the boundary portion parameter PBP, a boundary portion size parameter, and the number of scan lines included in the boundary portion BP may be set by the boundary portion size parameter.

In some example embodiments, the boundary portion setter 170 may determine the third driving frequency DF3 for the boundary portion BP such that the third driving frequency DF3 may gradually decrease in a direction from one of the first and second partial panel regions PPR1 and PPR2 driven at a higher one of the first and second driving frequencies DF1 and DF2 to the other one of the first and second partial panel regions PPR1 and PPR2 driven at a lower one of the first and second driving frequencies DF1 and DF2. Here, the term "gradually decrease" refers to that the third driving frequency includes one or more values between the values of the first driving frequency and second driving frequency, and is applied in the boundary portion BP in a generally descending order from a location adjacent to one of the first and second partial panel regions PPR1 and PPR2 with a higher one of the first and second driving frequencies DF1 and DF2 to a location adjacent to the other one of the first and second partial panel regions PPR1 and PPR2 driven at a lower one of the first and second driving frequencies DF1 and DF2. In the example of FIG. 7, the third driving frequency DF3 for the boundary portion BP may gradually decrease from the 1281st scan line SL1281 close (e.g., closer) to the first partial panel region PPR1 driven at the relatively higher first driving frequency DF1 to the 1290th scan line SL1290 close (e.g., closer) to the second partial panel region PPR2 driven at the relatively lower second driving frequency DF2. In an example, the third driving frequency DF3 for the boundary portion BP may gradually decrease per scan line. In another example, the third driving frequency DF3 for the boundary portion BP may gradually decrease per N scan lines, where N is an integer greater than 0 (e.g., equal to or greater than 1). In other example embodiments, the third driving frequency DF3 for the boundary portion BP may roughly (e.g., generally) decrease from the first partial panel region PPR1 driven at the relatively higher first driving frequency DF1 to the second partial panel region PPR2 driven at the relatively lower second driving frequency DF2. However, the third driving frequency DF3 for two directly adjacent scan lines included in the boundary portion BP may suitably increase or decrease. Further, in some example embodiments, the third driving frequency DF3 for the boundary portion BP may be determined based on the boundary portion parameter PBP. For example, the controller 140 may store, as the boundary portion parameter PBP, a boundary portion frequency parameter including a frequency interval parameter, a frequency change amount parameter, etc., and the third driving frequency DF3 may be determined or set based on the boundary portion frequency parameter.

As the output image data ODAT provided to the data driver 120, the data output unit 180 may output the first partial image data PDAT1 and the second partial image data PDAT2 except for boundary image data BDAT for the boundary portion BP at the first driving frequency DF1 and the second driving frequency DF2, respectively, and may output the boundary image data BDAT for the boundary portion BP at the third driving frequency DF3. Thus, the first partial panel region PPR1 except for the boundary portion BP may be driven at the first driving frequency DF1, the second partial panel region PPR2 except for the boundary portion BP may be driven at the second driving frequency DF2, and the boundary portion BP may be driven at the third driving frequency DF3.

For example, as illustrated in FIGS. 7 and 8, in a case where the input image data DAT are received at the input frame frequency IFF of about 120 Hz, the first driving frequency DF1 for the first partial panel region PPR1 is determined as about 120 Hz, and the second driving frequency DF2 for the second partial panel region PPR2 is determined as about 15 Hz, the boundary portion setter 170 may set a portion of the second partial panel region PPR2, for example, the 1281st through 1290th scan lines SL1281, . . . , SL1290 as the boundary portion BP, and may determine the third driving frequency DF3 for the boundary portion BP to be higher than about 15 Hz and lower than about 120 Hz. Further, in an example, the boundary portion setter 170 may set the third driving frequency DF3-1 for a first portion (e.g., the 1281st through 1285th scan lines) of the boundary portion BP as about 60 Hz, and may set the third driving frequency DF3-2 fora second portion (e.g., the 1286th through 1290th scan lines) of the boundary portion BP as about 30 Hz. In this case, the controller 140 may receive, as the input image data IDAT, 120 frame data FDAT in about 1 second at the input frame frequency IFF of about 120 Hz, and the data output unit 180 of the controller 140 may output the first partial image data PDAT1 120 times and the second partial image data PDAT2 15 times in about 1 second such that the first and second partial image data PDAT1 and PDAT2 except for boundary image data BDAT may be output at the first and second driving frequencies DF1 and DF2 of about 120 Hz and about 15 Hz. Thus, during eight frames, the data output unit 180 may output the first partial image data PDAT1 eight times, and may output the second partial image data PDAT2 once. Further, the data output unit 180 may output first boundary image data BDAT1 for the first portion of the boundary portion BP 60 times in about 1 second such that the first boundary image data BDAT1 may be output at the third driving frequency DF3-1 of about 60 Hz, and may output second boundary image data BDAT2 for the second portion of the boundary portion BP 30 times in about 1 second such that the second boundary image data BDAT2 may be output at the third driving frequency DF3-2 of about 30 Hz. Thus, during eight frames, the data output unit 180 may output the first boundary image data BDAT1 four times, and may output the second boundary image data BDAT2 twice.

The data driver 120 may receive the first partial image data PDAT1, the second partial image data PDAT2 and the boundary image data BDAT at the first driving frequency DF1, the second driving frequency DF2 and the third driving frequency DF3, respectively, and may provide the data signals DS to the display panel 110 based on the first partial image data PDAT1, the second partial image data PDAT2 and the boundary image data BDAT. Because the first partial image data PDAT1, the second partial image data PDAT2 and the boundary image data BDAT are received at the first driving frequency DF1, the second driving frequency DF2 and the third driving frequency DF3, respectively, the data driver 120 may provide the data signals DS to the first partial panel region PPR1 at the first driving frequency DF1, may provide the data signals DS to the second partial panel region PPR2 at the second driving frequency DF2, and may provide the data signals DS to the boundary portion BP at the third driving frequency DF3. Further, the scan driver 130 may provide the scan signals SS to the first partial panel region PPR1 at the first driving frequency DF1, may provide the scan signals SS to the second partial panel region PPR2 at the second driving frequency DF2, and may provide the scan signals SS to the boundary portion BP at the third driving frequency DF3. Accordingly, the first partial panel region PPR1 may be driven at the first driving frequency DF1, the second partial panel region PPR2 may be driven at the second driving frequency DF2, and the boundary portion BP may be driven at the third driving frequency DF3 between the first driving frequency DF1 and the second driving frequency DF2.

In a related art case where the first and second partial panel regions PPR1 and PPR2 are driven at the different first and second driving frequencies DF1 and DF2, and no boundary portion BP is set, a frequency change at the boundary PPRB between the first and second partial panel region PPR1 and PPR2 may be perceived by a user. However, in the display device 100 according to example embodiments, when the first and second driving frequencies DF1 and DF2 for the first and second partial panel regions PPR1 and PPR2 are different from each other, the third driving frequency DF3 for the boundary portion BP may be determined to be between the first driving frequency DF1 and the second driving frequency DF2. Accordingly, even when the first and second partial panel regions PPR1 and PPR2 are driven at the different first and second driving frequencies DF1 and DF2, the frequency change at the boundary PPRB between the first and second partial panel regions PPR1 and PPR2 may not be perceived by the user.

Figure 9:
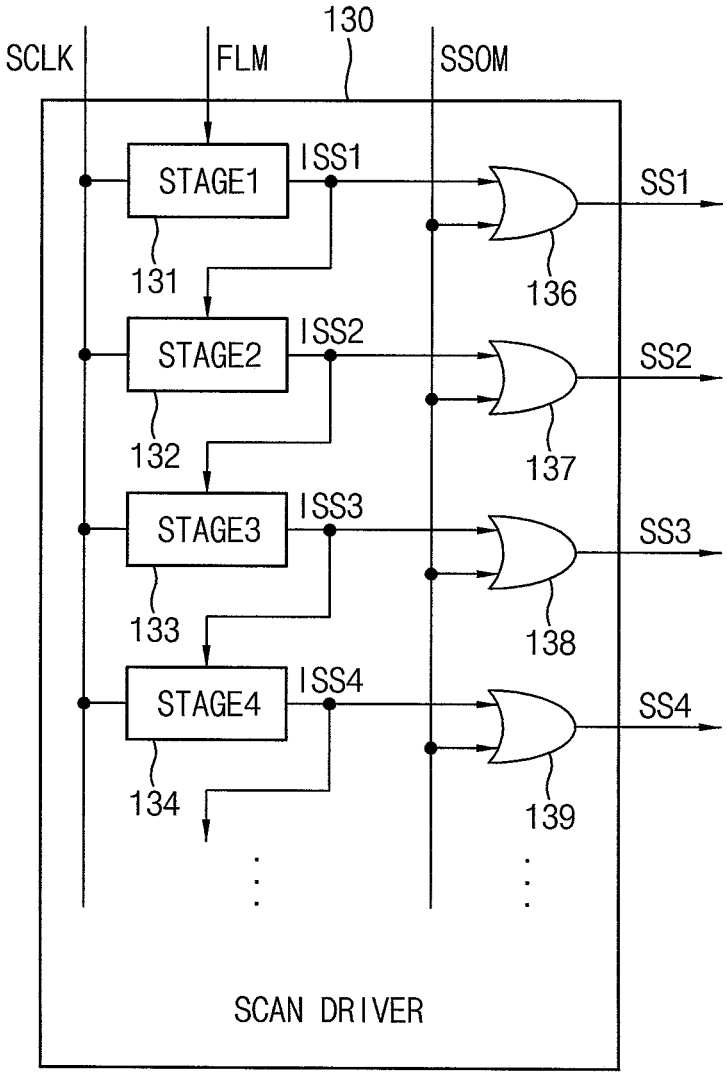
FIG. 9 is a block diagram illustrating an example of a scan driver included in a display device according to example embodiments.
Figure 10:
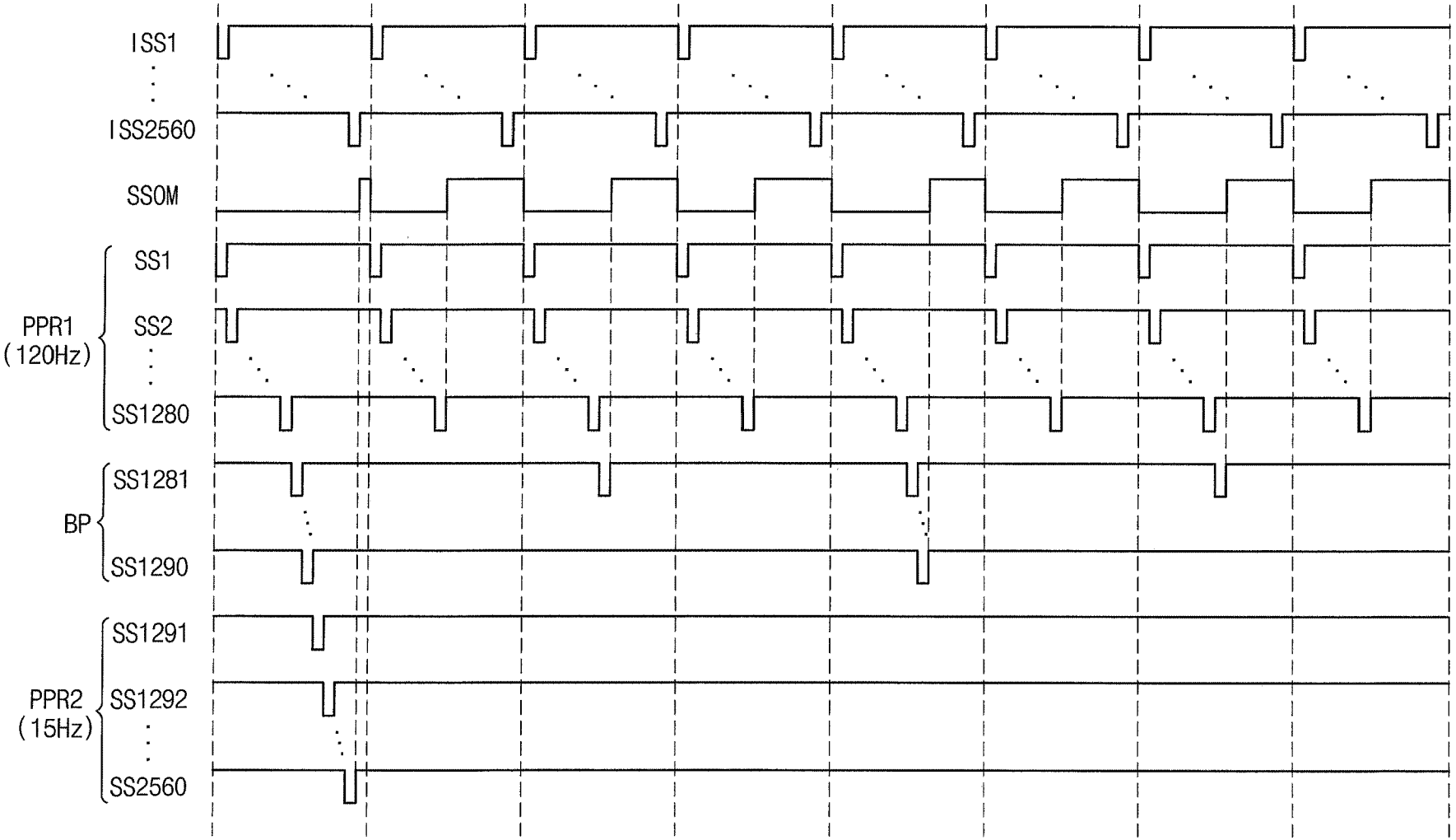
FIG. 10 is a timing diagram for describing an example of an operation of a scan driver included in a display device according to example embodiments.

FIG. 9 is a block diagram illustrating an example of a scan driver included in a display device according to example embodiments, and FIG. 10 is a timing diagram for describing an example of an operation of a scan driver included in a display device according to example embodiments.

Referring to FIGS. 1, 7, 8, 9 and 10, a scan driver 130 included in a display device 100 according to example embodiments may provide scan signals SS to a first partial panel region PPR1 at a first driving frequency DF1, may provide the scan signals SS to a second partial panel region PPR2 at a second driving frequency DF2, and may provide the scan signals SS to the boundary portion BP at a third driving frequency DF3. To perform these operations, the scan driver 130 may include a plurality of stages 131, 132, 133, 134, . . . , and a plurality of logic gates 136, 137, 138, 139, . . . respectively connected to the plurality of stages 131, 132, 133, 134, . . . .

The plurality of stages 131, 132, 133, 134, . . . may generate a plurality of intermediate scan signals ISS1 through ISS2560 respectively corresponding to a plurality of scan lines SL1 through SL2560, included in a display panel 110 at an input frame frequency IFF based on a scan start signal FLM and a scan clock signal SCLK.

The plurality of logic gates 136, 137, 138, 139, . . . may selectively output, as a plurality of scan signals SS1 through SS2560, the plurality of intermediate scan signals ISS1 through ISS2560 generated by the plurality of stages 131, 132, 133, 134, . . . in response to a scan output masking signal SSOM, respectively. That is, the plurality of logic gates 136, 137, 138, 139, . . . may selectively output a plurality of scan signals SS1 through SS2560, in response to a scan output masking signal SSOM and the plurality of intermediate scan signals ISS1 through ISS2560 generated by the plurality of stages 131, 132, 133, 134, . . . respectively. In some example embodiments, as illustrated in FIG. 9, the plurality of logic gates 136, 137, 138, 139, . . . may be, but not be limited to, a plurality of OR gates that perform OR operations on the plurality of intermediate scan signals ISS1 through ISS2560 and the scan output masking signal SSOM. For example, each logic gate (e.g., 136) may output a corresponding scan signal (e.g., SS1) having a low level when both of a corresponding intermediate scan signal (e.g., ISS1) and the scan output masking signal SSOM have the low level.

For example, as illustrated in FIGS. 7, 8 and 10, in a case where the first driving frequency DF1 for the first partial panel region PPR1 is determined to be substantially the same as the input frame frequency IFF of about 120 Hz, the second driving frequency DF2 for the second partial panel region PPR2 is determined as about 15 Hz, the third driving frequency DF3-1 for a first portion (e.g., 1281st through 1285th scan lines) of the boundary portion BP is set as about 60 Hz, and the third driving frequency DF3-2 for a second portion (e.g., 1286th through 1290th scan lines) of the boundary portion BP is set as about 30 Hz, the plurality of stages 131, 132, 133, 134, . . . may generate the plurality of intermediate scan signals ISS1 through ISS2560 at the input frame frequency IFF of about 120 Hz, 1st through 1280th logic gates may output 1st through 1280th scan signals SS1 through SS1280 at the first driving frequency DF1 of about 120 Hz in response to the scan output masking signal SSOM, 1281st through 1285th logic gates may output 1281st through 1285th scan signals SS1281, . . . at the third driving frequency DF3-1 of about 60 Hz with respect to the first portion of the boundary portion BP in response to the scan output masking signal SSOM, 1286th through 1290th logic gates may output 1286th through 1290th scan signals . . . , SS1290 at the third driving frequency DF3-2 of about 30 Hz with respect to the second portion of the boundary portion BP in response to the scan output masking signal SSOM, and 1291st through 2560th logic gates may output 1291st through 2560th scan signals SS1291 through SS2560 at the second driving frequency DF2 of about 15 Hz in response to the scan output masking signal SSOM. Accordingly, the first partial panel region PPR1 may be driven at the first driving frequency DF1, the second partial panel region PPR2 may be driven at the second driving frequency DF2, and the boundary portion BP may be driven at the third driving frequency DF3-1 and DF3-2 between the first driving frequency DF1 and the second driving frequency DF2.

Figure 11:
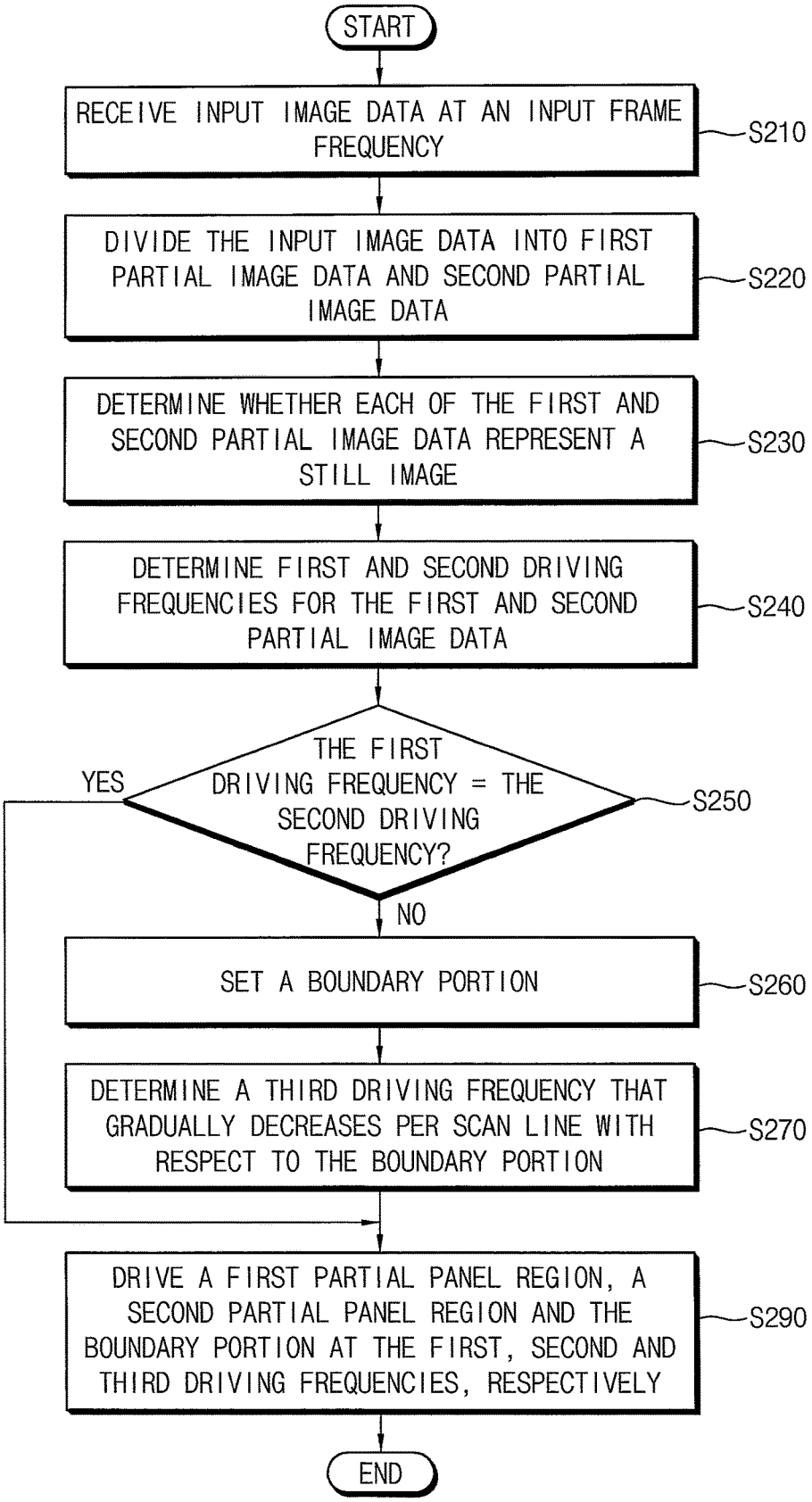
FIG. 11 is a flowchart illustrating a method of operating a display device according to example embodiments.
Figure 12:
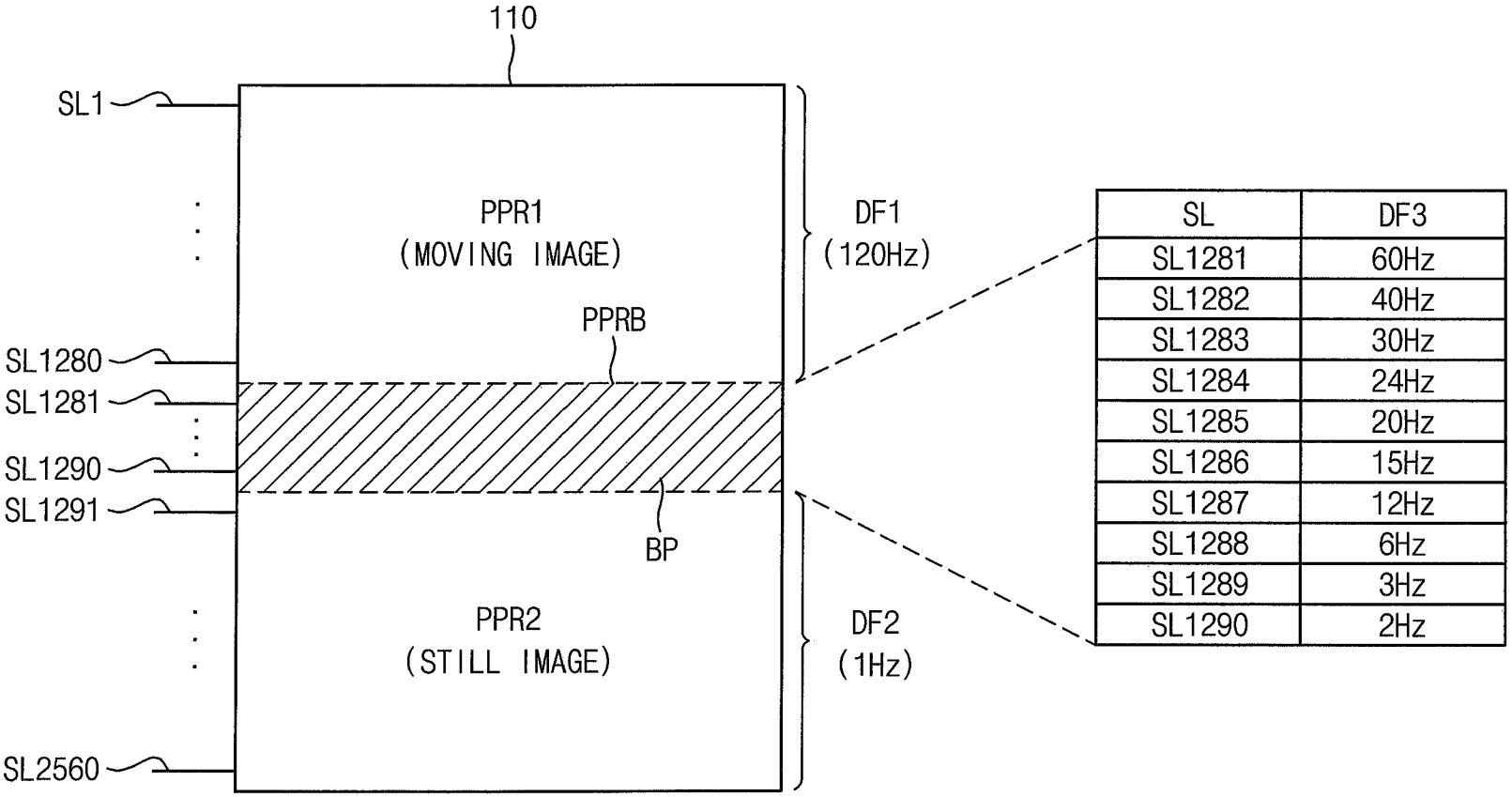
FIG. 12 is a diagram for describing an example where a driving frequency for a boundary portion gradually decreases per scan line according to a method of FIG. 11.

FIG. 11 is a flowchart illustrating a method of operating a display device according to example embodiments, and FIG. 12 is a diagram for describing an example where a driving frequency for a boundary portion gradually decreases per scan line according to a method of FIG. 11.

Referring to FIGS. 1 and 11, a display device 100 according to example embodiments may receive input image data IDAT at an input frame frequency IFF (S210). A still image detector 150 may divide the input image data IDAT into first partial image data PDAT1 for a first partial panel region PPR1 and second partial image data PDAT2 for a second partial panel region PPR2 (S220), and may determine whether each of the first partial image data PDAT1 and the second partial image data PDAT2 represent a still image (S230).

A driving frequency decider 160 may determine a first driving frequency DF1 for the first partial panel region PPR1 according to whether the first partial image data PDAT1 represent the still image, and may determine a second driving frequency DF2 for the second partial panel region PPR2 according to whether the second partial image data PDAT2 represent the still image (S240). For example, the driving frequency decider 160 may determine the first driving frequency DF1 for the first partial panel region PPR1 as the input frame frequency IFF when the first partial image data PDAT1 do not represent the still image (and/or represent a moving image), and may determine the first driving frequency DF1 for the first partial panel region PPR1 as a frequency lower than the input frame frequency IFF when the first partial image data PDAT1 represent the still image. Further, the driving frequency decider 160 may determine the second driving frequency DF2 for the second partial panel region PPR2 as the input frame frequency IFF when the second partial image data PDAT2 do not represent the still image (and/or represent the moving image), and may determine the second driving frequency DF2 for the second partial panel region PPR2 as a frequency lower than the input frame frequency IFF when the second partial image data PDAT2 represent the still image.

A boundary portion setter 170 may compare the first driving frequency DF1 and the second driving frequency DF2 (S250). When the first driving frequency DF1 and the second driving frequency DF2 are substantially the same (S250: YES), a boundary portion may not be set, the first partial panel region PPR1 may be driven at the first driving frequency DF1, and the second partial panel region PPR2 may be driven at the second driving frequency DF2 (S290). That is, in this case, the first partial panel region PPR1 may be driven at the first driving frequency DF1, and the second partial panel region PPR2 may be driven at the second driving frequency DF2 (S290), where the first and second driving frequencies DF1 and DF2 are substantially the same.

When the first driving frequency DF1 and the second driving frequency DF2 are different from each other (S250: NO), the boundary portion setter 170 may set a boundary portion including a boundary PPRB between the first partial panel region PPR1 and the second partial panel region PPR2 (S260), and may determine a third driving frequency DF3 for the boundary portion to be between the first driving frequency DF1 and the second driving frequency DF2 (S270). In some example embodiments, as illustrated in FIG. 12, the boundary portion setter 170 may determine the third driving frequency DF3 for the boundary portion such that the third driving frequency DF3 may gradually decrease per scan line in a direction from one of the first and second partial panel regions PPR1 and PPR2 driven at a higher one of the first and second driving frequencies DF1 and DF2 to the other one of the first and second partial panel regions PPR1 and PPR2 driven at a lower one of the first and second driving frequencies DF1 and DF2.

For example, as illustrated in FIG. 12, in a case where the moving image is displayed in the first partial panel region PPR1 including 1st through 1280th scan lines SL1 through SL1280, and the still image is displayed in the second partial panel region PPR2 including 1281st through 2560th scan lines SL1281 through SL2560, the first driving frequency DF1 for the first partial panel region PPR1 may be determined to be substantially the same as the input frame frequency IFF of about 120 Hz, and the second driving frequency DF2 for the second partial panel region PPR2 may be determined as about 1 Hz (which is lower than the input frame frequency IFF). The boundary portion setter 170 may set a portion of the second partial panel region PPR2 driven at the relatively lower second driving frequency DF2, for example, the 1281st through 1290th scan lines SL1281, . . . , SL1290 as the boundary portion BP. Further, the boundary portion setter 170 may determine the third driving frequency DF3 for the boundary portion BP such that the third driving frequency DF3 may gradually decrease per scan line from the 1281st scan line SL1281 close (e.g., closer) to the first partial panel region PPR1 driven at the relatively higher first driving frequency DF1 to the 1290th scan line SL1290 close (e.g., closer) to the second partial panel region PPR2 driven at the relatively lower second driving frequency DF2. For example, the boundary portion setter 170 may set the third driving frequency DF3 for the 1281st scan line SL1281 as about 60 Hz, may set the third driving frequency DF3 for the 1282nd scan line SL1282 as about 40 Hz, may set the third driving frequency DF3 for the 1283rd scan line SL1283 as about 30 Hz, may set the third driving frequency DF3 for the 1284th scan line SL1284 as about 24 Hz, may set the third driving frequency DF3 for the 1285th scan line SL1285 as about 20 Hz, may set the third driving frequency DF3 for the 1286th scan line SL1286 as about 15 Hz, may set the third driving frequency DF3 for the 1287th scan line SL1287 as about 12 Hz, may set the third driving frequency DF3 for the 1288th scan line SL1288 as about 6 Hz, may set the third driving frequency DF3 for the 1289th scan line SL1289 as about 3 Hz, and may set the third driving frequency DF3 for the 1290th scan line SL1290 as about 2 Hz.

A panel driver 190 may drive the first partial panel region PPR1 at the first driving frequency DF1, may drive the second partial panel region PPR2 at the second driving frequency DF2, and may drive the boundary portion BP at the third driving frequency DF3 that gradually decreases per scan line in a direction from the first partial panel region PPR1 driven at the relatively higher first driving frequency DF1 to the second partial panel region PPR2 driven at the relatively lower second driving frequency DF2 (S290). Accordingly, even when the first and second partial panel regions PPR1 and PPR2 are driven at the different first and second driving frequencies DF1 and DF2, a frequency change between the first and second partial panel region PPR1 and PPR2 may not be perceived (e.g., by the user).

Figure 13:
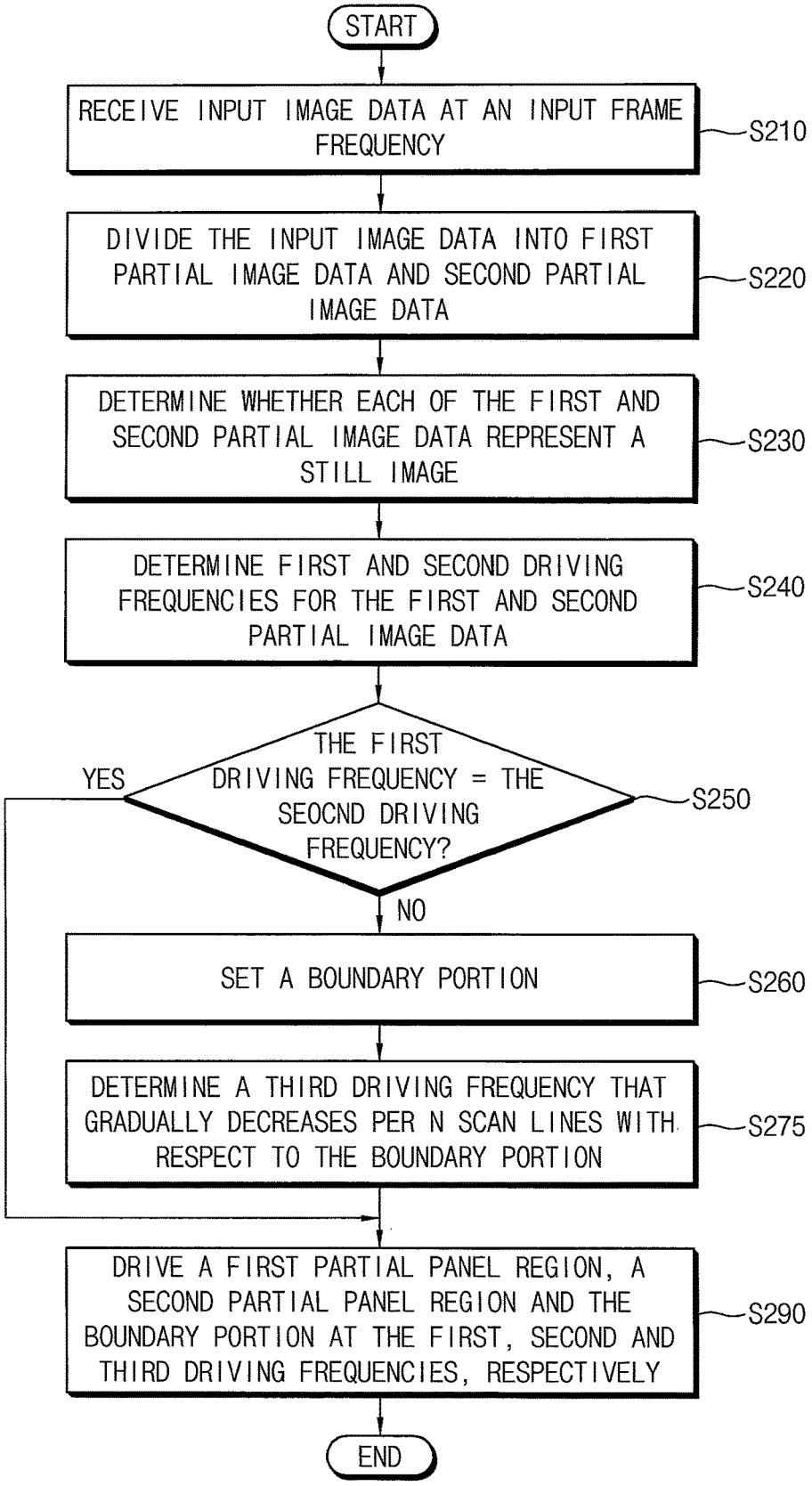
FIG. 13 is a flowchart illustrating a method of operating a display device according to example embodiments.
Figure 14:
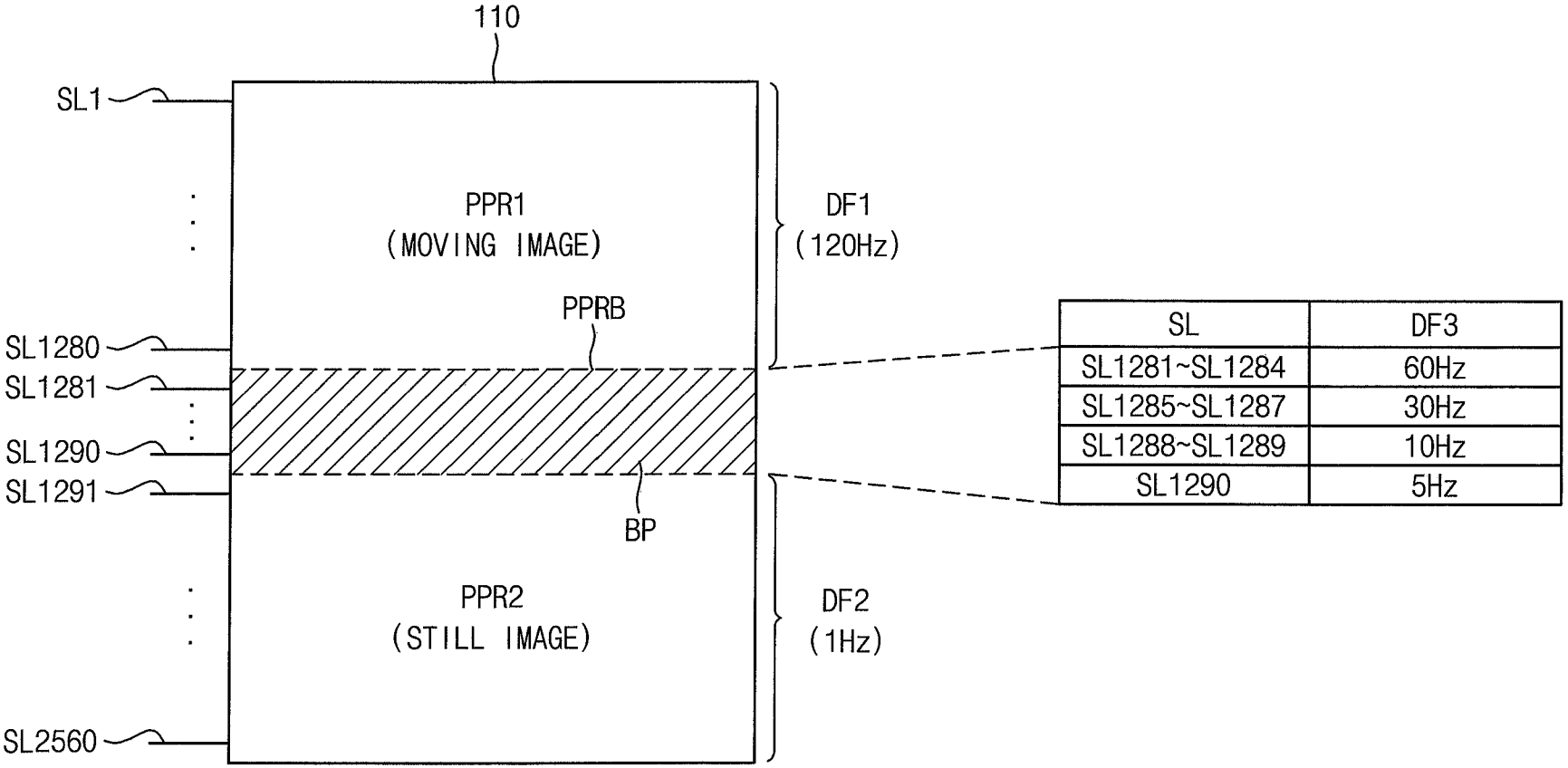
FIG. 14 is a diagram for describing an example where a driving frequency for a boundary portion gradually decreases per one or more scan lines according to a method of FIG. 13.

FIG. 13 is a flowchart illustrating a method of operating a display device according to example embodiments, and FIG. 14 is a diagram for describing an example where a driving frequency for a boundary portion gradually decreases per one or more scan lines according to the method of FIG. 13.

The method of FIG. 13 may be substantially the same as the method of FIG. 11, except that a third driving frequency DF3 for a boundary portion may gradually decrease per N scan lines (S275), where N is an integer greater than 0 (e.g., equal to or greater than 1). In the method of FIG. 13, a boundary portion setter 170 may determine the third driving frequency DF3 for the boundary portion such that the third driving frequency DF3 may gradually decrease per the N scan lines in a direction from one of the first and second partial panel regions PPR1 and PPR2 driven at a higher one of the first and second driving frequencies DF1 and DF2 to the other one of the first and second partial panel regions PPR1 and PPR2 driven at a lower one of the first and second driving frequencies DF1 and DF2 (S275).

For example, as illustrated in FIG. 14, in a case where the moving image is displayed in the first partial panel region PPR1 including 1st through 1280th scan lines SL1 through SL1280, and the still image is displayed in the second partial panel region PPR2 including 1281st through 2560th scan lines SL1281 through SL2560, the first driving frequency DF1 for the first partial panel region PPR1 may be determined to be substantially the same as an input frame frequency IFF of about 120 Hz, and the second driving frequency DF2 for the second partial panel region PPR2 may be determined as about 1 Hz (which is lower than the input frame frequency IFF). The boundary portion setter 170 may set a portion of the second partial panel region PPR2 driven at the relatively lower second driving frequency DF2, for example, the 1281st through 1290th scan lines SL1281, . . . , SL1290 as the boundary portion BP. Further, the boundary portion setter 170 may determine the third driving frequency DF3 for the boundary portion BP such that the third driving frequency DF3 may gradually decrease per one or more scan lines from the 1281st scan line SL1281 (close to the first partial panel region PPR1 driven at the relatively higher first driving frequency DF1) to the 1290th scan line SL1290 (close to the second partial panel region PPR2 driven at the relatively lower second driving frequency DF2). For example, the boundary portion setter 170 may set the third driving frequency DF3 for the 1281st through 1284th scan lines SL1281 through SL1284 as about 60 Hz, may set the third driving frequency DF3 for the 1285th through 1287th scan lines SL1285 through SL1287 as about 30 Hz, may set the third driving frequency DF3 for the 1288th and 1289th scan line SL1288 and SL1289 as about 10 Hz, and may set the third driving frequency DF3 for the 1290th scan line SL1290 as about 5 Hz.

A panel driver 190 may drive the first partial panel region PPR1 at the first driving frequency DF1, may drive the second partial panel region PPR2 at the second driving frequency DF2, and may drive the boundary portion BP at the third driving frequency DF3 that gradually decreases per one or more scan lines in a direction from the first partial panel region PPR1 driven at the relatively higher first driving frequency DF1 to the second partial panel region PPR2 driven at the relatively lower second driving frequency DF2 (S290). Accordingly, even when the first and second partial panel regions PPR1 and PPR2 are driven at the different first and second driving frequencies DF1 and DF2, a frequency change between the first and second partial panel region PPR1 and PPR2 may not be perceived (e.g., by the user).

Figure 15A:
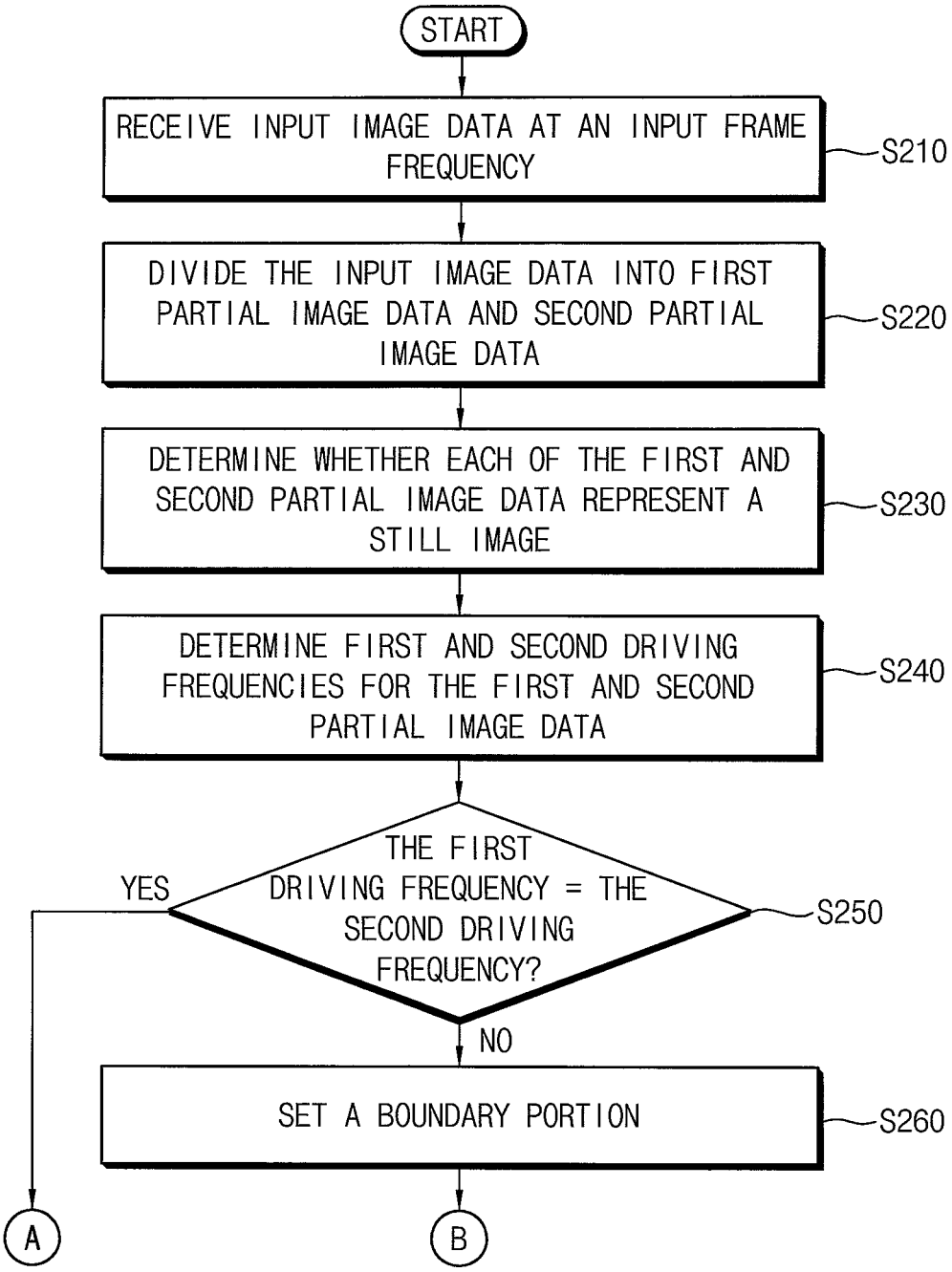
FIGS. 15A and 15B are first and second parts of a flowchart illustrating a method of operating a display device according to example embodiments.
Figure 15B:
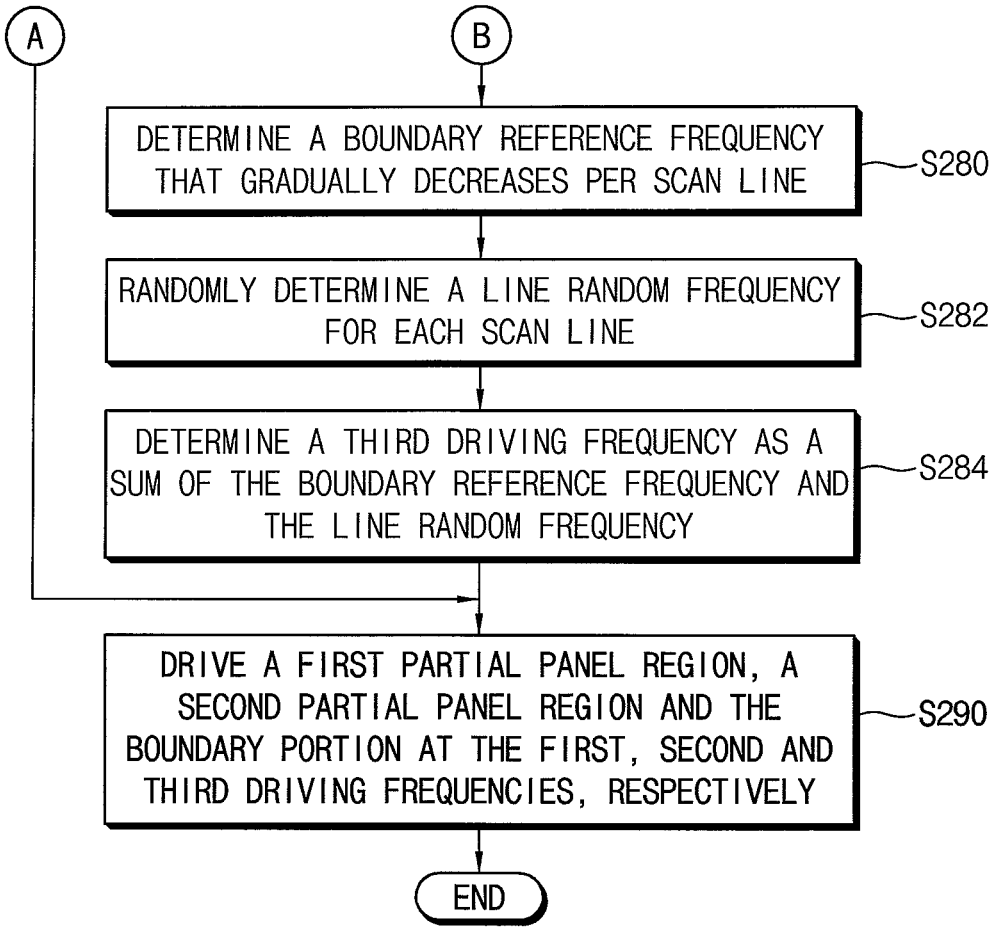
Figure 16:
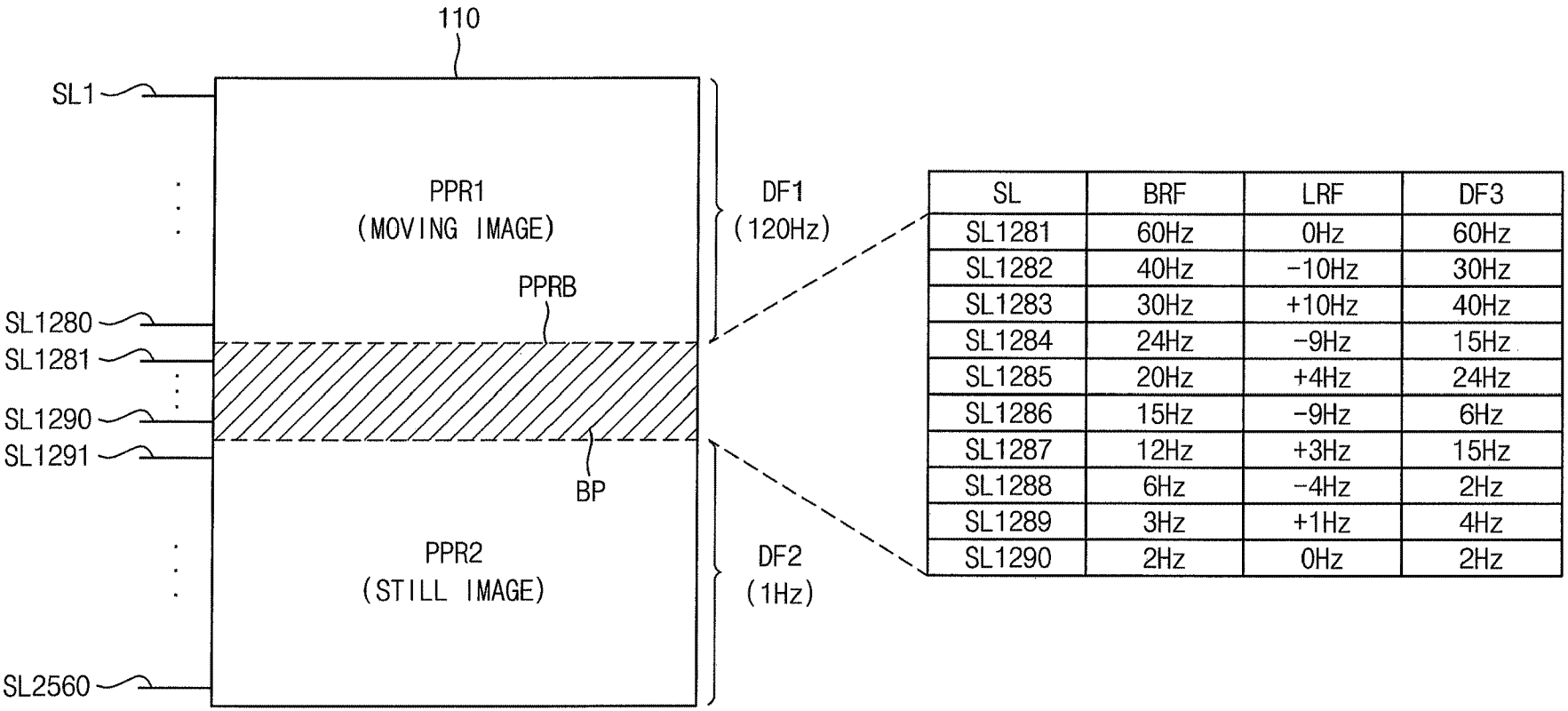
FIG. 16 is a diagram for describing an example where a driving frequency for a boundary portion is determined based on a boundary reference frequency and a line random frequency according to the method of FIGS. 15A and 15B.

FIGS. 15A and 15B are first and second parts of a flowchart (e.g., FIGS. 15A and 15B together forms a complete flowchart) illustrating a method of operating a display device according to example embodiments, and FIG. 16 is a diagram for describing an example where a driving frequency for a boundary portion is determined based on a boundary reference frequency and a line random frequency according to the method of FIGS. 15A and 15B.

The method of FIGS. 15A and 15B may be substantially the same as the method of FIG. 11, except that, with respect to a boundary portion, a boundary reference frequency may be determined (S280), a line random frequency may be determined (S282), and a third driving frequency DF3 may be determined based on the boundary reference frequency and the line random frequency (S284). In the method of FIGS. 15A and 15B, a boundary portion setter 170 may determine the boundary reference frequency that gradually decreases in a direction from one of the first and second partial panel regions PPR1 and PPR2 driven at a higher one of the first and second driving frequencies DF1 and DF2 to the other one of the first and second partial panel regions PPR1 and PPR2 driven at a lower one of the first and second driving frequencies DF1 and DF2 (S280), may randomly determine the line random frequency with respect to each of a plurality of scan lines included in the boundary portion (S282), and may determine the third driving frequency DF3 as a sum of the boundary reference frequency and the line random frequency (S284).

For example, as illustrated in FIG. 16, in a case where the moving image is displayed in the first partial panel region PPR1 including 1st through 1280th scan lines SL1 through SL1280, and the still image is displayed in the second partial panel region PPR2 including 1281st through 2560th scan lines SL1281 through SL2560, the first driving frequency DF1 for the first partial panel region PPR1 may be determined to be substantially the same as an input frame frequency IFF of about 120 Hz, and the second driving frequency DF2 for the second partial panel region PPR2 may be determined as about 1 Hz (which is lower than the input frame frequency IFF). The boundary portion setter 170 may set a portion of the second partial panel region PPR2 driven at the relatively lower second driving frequency DF2, for example, the 1281st through 1290th scan lines SL1281, . . . , SL1290 as the boundary portion BP. Further, the boundary portion setter 170 may determine the boundary reference frequency BRF that gradually decreases per scan line as about 60 Hz, about 40 Hz, about 30 Hz, about 24 Hz, about 20 Hz, about 15 Hz, about 12 Hz, about 6 Hz, about 3 Hz and about 2 Hz with respect to the 1281st through 1290th scan lines SL1281, . . . , SL1290, may randomly determine the line random frequency LRF as about 0 Hz, about −10 Hz, about +10 Hz, about −9 Hz, about +4 Hz, about −9 Hz, about +3 Hz, about −4 Hz, about +1 Hz and about 0 Hz with respect to the 1281st through 1290th scan lines SL1281, . . . , SL1290, and thus may determine the third driving frequency DF3 as about 60 Hz, about 30 Hz, about 40 Hz, about 15 Hz, about 24 Hz, about 6 Hz, about 15 Hz, about 2 Hz, about 4 Hz and about 2 Hz with respect to the 1281st through 1290th scan lines SL1281, . . . , SL1290. Accordingly, in the example of FIG. 16, the third driving frequency DF3 for the boundary portion BP may roughly (e.g., generally) decrease from the first partial panel region PPR1 driven at the relatively higher first driving frequency DF1 to the second partial panel region PPR2 driven at the relatively lower second driving frequency DF2. However, the third driving frequency DF3 for two directly adjacent scan lines included in the boundary portion BP may increase or decrease.

A panel driver 190 may drive the first partial panel region PPR1 at the first driving frequency DF1, may drive the second partial panel region PPR2 at the second driving frequency DF2, and may drive the boundary portion BP at the third driving frequency DF3 that roughly (e.g., generally) decreases in a direction from the first partial panel region PPR1 driven at the relatively higher first driving frequency DF1 to the second partial panel region PPR2 driven at the relatively lower second driving frequency DF2 (S290). Accordingly, even when the first and second partial panel regions PPR1 and PPR2 are driven at the different first and second driving frequencies DF1 and DF2, a frequency change between the first and second partial panel region PPR1 and PPR2 may not be perceived (e.g., by the user).

Figure 17:
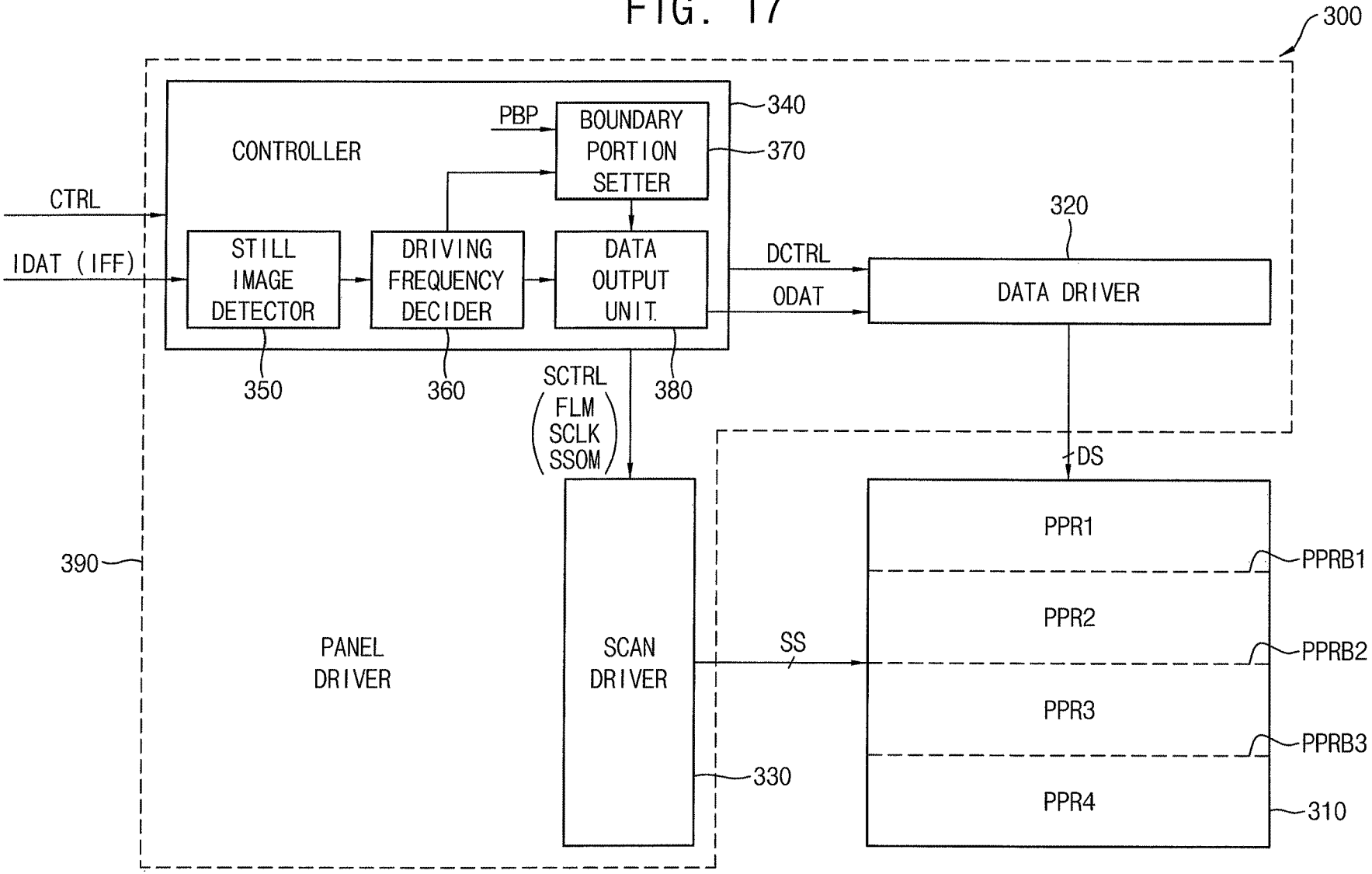
FIG. 17 is a block diagram illustrating a display device according to example embodiments.
Figure 18:
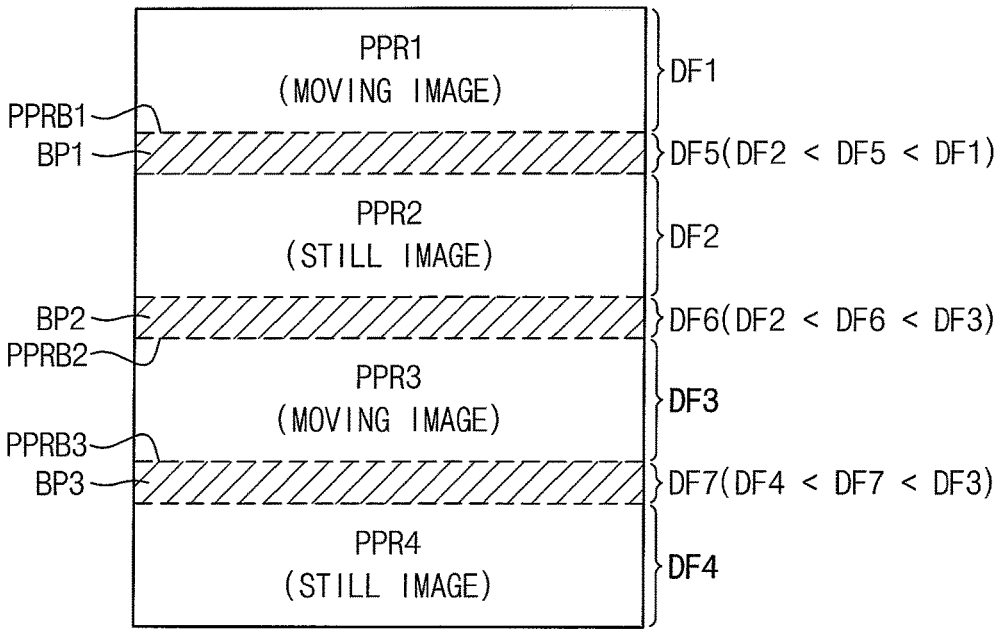
FIG. 18 is a diagram for describing an example where a boundary portion setter included in a display device sets a boundary portion according to example embodiments.

FIG. 17 is a block diagram illustrating a display device according to example embodiments, and FIG. 18 is a diagram for describing an example where a boundary portion setter included in a display device sets a boundary portion according to example embodiments.

Referring to FIG. 17, a display device 300 according to example embodiments may include a display panel 310, and a panel driver 390 that drives the display panel 310. In some example embodiments, the panel driver 390 may include a data driver 320, a scan driver 330, and a controller 340. Further, in some example embodiments, the controller 340 may include a still image detector 350, a driving frequency decider 360, a boundary portion setter 370 and a data output unit 380. The display device 300 of FIG. 17 may have a similar operation and a similar configuration to a display device 100 of FIG. 1, except that the display panel 310 may include three or more partial panel regions PPR1, PPR2, PPR3 and PPR4, and the boundary portion setter 370 may set at least one boundary portion including a boundary PPRB1, PPRB2 and/or PPRB3 between adjacent two panel regions of the three or more partial panel regions PPR1, PPR2, PPR3 and PPR4.

For example, as illustrated in FIG. 18, in a case where a moving image is displayed in a first portion of the display panel 310, a still image is displayed in a second portion of the display panel 310, a moving image is displayed in a third portion of the display panel 310, and a still image is displayed in a fourth portion of the display panel 310, the panel driver 390 may set the first portion of the display panel 310 in which the moving image is displayed as a first partial panel region PPR1, may set the second portion of the display panel 310 in which the still image is displayed as a second partial panel region PPR2, may set the third portion of the display panel 310 in which the moving image is displayed as a third partial panel region PPR3, and may set the fourth portion of the display panel 310 in which the still image is displayed as a fourth partial panel region PPR4. In some example embodiments, the number and positions of the partial panel regions PPR1, PPR2, PPR3 and PPR4 of the display panel 310 set by the panel driver 390 may be dynamically changed according to the number and positions of the moving images and the still images.

The driving frequency decider 360 may respectively determine first through fourth driving frequencies DF1, DF2, DF3 and DF4 for the first through fourth partial panel regions PPR1, PPR2, PPR3 and PPR4. For example, the driving frequency decider 360 may determine the first driving frequency DF1 for the first partial panel region PPR1 in which the moving image is displayed to be substantially the same as an input frame frequency IFF, may determine the second driving frequency DF2 for the second partial panel region PPR2 in which the still image is displayed to be lower than the input frame frequency IFF, may determine the third driving frequency DF3 for the third partial panel region PPR3 in which the moving image is displayed to be substantially the same as the input frame frequency IFF, and may determine the fourth driving frequency DF4 for the fourth partial panel region PPR4 in which the still image is displayed to be lower than the input frame frequency IFF.

When the driving frequencies for two adjacent partial panel regions of the first through fourth partial panel regions PPR1, PPR2, PPR3 and PPR4 are different from each other, the boundary portion setter 370 may set a boundary portion BP1, BP2 and BP3 including a boundary PPRB1, PPRB2 and PPRB3 between the two adjacent partial panel regions of the first through fourth partial panel regions PPR1, PPR2, PPR3 and PPR4, and may set a driving frequency for the boundary portion BP1, BP2 and BP3 to be between the driving frequencies for the two adjacent partial panel regions of the first through fourth partial panel regions PPR1, PPR2, PPR3 and PPR4.

For example, as illustrated in FIG. 18, the boundary portion setter 370 may set a portion of the second partial panel region PPR2 as a first boundary portion BP1 between the first and second partial panel regions PPR1 and PPR2, may set another portion of the second partial panel region PPR2 as a second boundary portion BP2 between the second and third partial panel regions PPR2 and PPR3, and may set a portion of the fourth partial panel region PPR4 as a third boundary portion BP3 between the third and fourth partial panel regions PPR3 and PPR4. Further, the boundary portion setter 370 may set a fifth driving frequency DF5 for the first boundary portion BP1 to be higher than the second driving frequency DF2 for the second partial panel region PPR2 and lower than the first driving frequency DF1 for the first partial panel region PPR1, may set a sixth driving frequency DF6 for the second boundary portion BP2 to be higher than the second driving frequency DF2 for the second partial panel region PPR2 and lower than the third driving frequency DF3 for the third partial panel region PPR3, and may set a seventh driving frequency DF6 for the third boundary portion BP3 to be higher than the fourth driving frequency DF4 for the fourth partial panel region PPR4 and lower than the third driving frequency DF3 for the third partial panel region PPR3. In some example embodiments, the boundary portion setter 370 may set the fifth driving frequency DF5 for the first boundary portion BP1 to gradually decrease in a direction from the first partial panel region PPR1 to the second partial panel region PPR2, may set the sixth driving frequency DF6 for the second boundary portion BP2 to gradually decrease in a direction from the third partial panel region PPR3 to the second partial panel region PPR2, and may set the seventh driving frequency DF6 for the third boundary portion BP3 to gradually decrease in a direction from the third partial panel region PPR3 to the fourth partial panel region PPR4. Accordingly, even when the two adjacent partial panel regions of the first through fourth partial panel regions PPR1, PPR2, PPR3 and PPR4 are driven at the different driving frequencies, a frequency change between the adjacent two partial panel regions of the first through fourth partial panel regions PPR1, PPR2, PPR3 and PPR4 may not be perceived (e.g., by the user).

Figure 19:
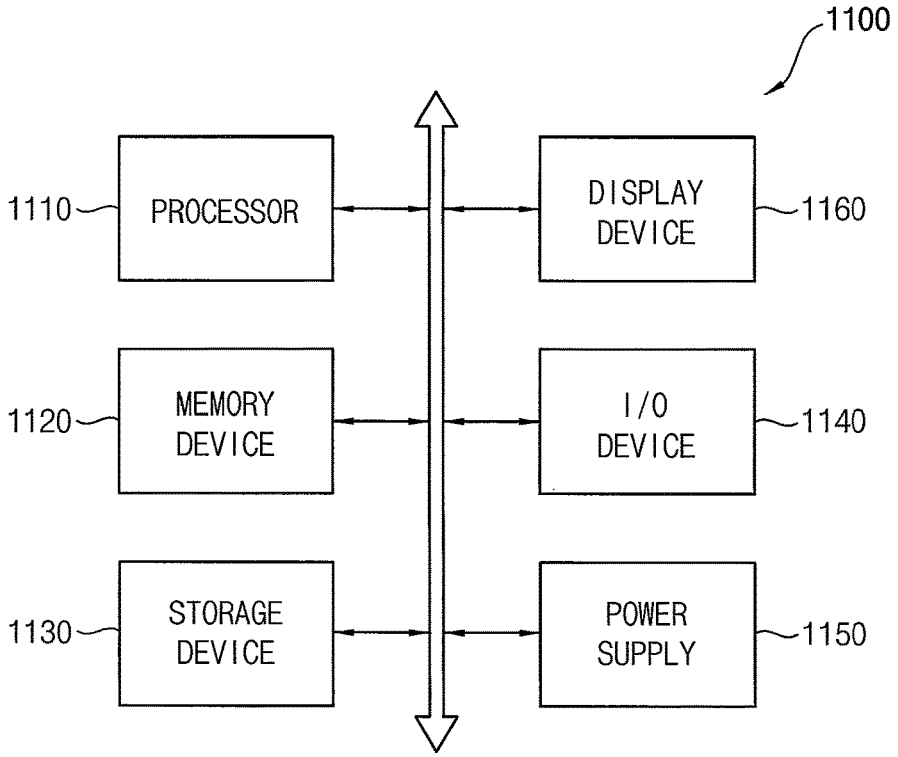
FIG. 19 is a block diagram illustrating an electronic device including a display device according to example embodiments.

FIG. 19 is an electronic device including a display device according to example embodiments.

Referring to FIG. 19, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various suitable computing functions or tasks. The processor 1110 may be an application processor (AP), a micro processor, a central processing unit (CPU), etc. The processor 1110 may be coupled to other components via an address bus, a control bus, a data bus, etc. Further, in some example embodiments, the processor 1110 may be further coupled to an extended bus (such as a peripheral component interconnection (PCI) bus).

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and/or an output device such as a printer, a speaker, etc. The power supply 1150 may supply power for operations of the electronic device 1100. The display device 1160 may be coupled to other components through the buses or other communication links.

In a case where a first driving frequency for a first partial panel region and a second driving frequency for a second partial panel region are different from each other, the display device 1160 according to example embodiments may determine a third driving frequency for a boundary portion including a boundary between the first partial panel region and the second partial panel region to be between the first driving frequency and the second driving frequency. Accordingly, even when the first and second partial panel regions are driven at the different driving frequencies, a frequency change between the first and second partial panel regions may not be perceived (e.g., by the user).

The subject matter of the present disclosure may be applied to any suitable display device 1160, and any suitable electronic device 1100 including the display device 1160. For example, the subject matter of the present disclosure may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

Expressions such as "at least one of" or "at least one selected from" when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration. It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. In contrast, when an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art. Moreover, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112, first paragraph, or 35 U.S.C. § 112(a), and 35 U.S.C. § 132(a).

The display device and/or any other relevant devices or components according to embodiments of the present invention described herein may be implemented utilizing any suitable hardware, firmware (e.g. an application-specific integrated circuit), software, or a combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on one substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present disclosure. Accordingly, all such modifications are intended to be included within the scope of the present disclosure as defined in the claims, and equivalents thereof. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A display device comprising:

a display panel comprising a first partial panel region and a second partial panel region; and a panel driver to drive the display panel, wherein the panel driver is to further determine a first driving frequency for the first partial panel region and a second driving frequency for the second partial panel region, and wherein, when the first driving frequency is higher than the second driving frequency, the panel driver is to further set a boundary portion comprising a boundary between the first partial panel region and the second partial panel region and to determine a third driving frequency for the boundary portion to be between the first driving frequency and the second driving frequency such that the third driving frequency is lower than the first driving frequency and is higher than the second driving frequency, wherein each of the first and second partial panel regions comprises a plurality of pixels, and wherein each of the plurality of pixels comprises:

a driving transistor to generate a driving current;

a switching transistor to transfer a data signal to a source of the driving transistor; a compensating transistor to diode-connect the driving transistor in response to a scan signal; and an organic light emitting diode to emit light based on the driving current, and wherein, when a still image is displayed in the second partial panel region, a frequency of the scan signal provided to each of the plurality of pixels in the second partial panel region is different from a frequency of the scan signal provided to each of the plurality of pixels in the first partial panel region;

wherein each of the plurality of pixels further comprises:

an initializing transistor to provide an initialization voltage to a gate electrode of the driving transistor in response to an initialization signal, and wherein, when the still image is displayed in the second partial panel region, a frequency of the initialization signal provided to each of the plurality of pixels in the second partial panel region is different from a frequency of the initialization signal provided to each of the plurality of pixels in the first partial panel region.

2. The display device of claim 1, wherein the third driving frequency gradually decreases in a direction from one of the first and second partial panel regions driven at a higher one of the first and second driving frequencies to the other one of the first and second partial panel regions driven at a lower one of the first and second driving frequencies.

3. The display device of claim 2, wherein the third driving frequency gradually decreases per scan line.

4. The display device of claim 2, wherein the third driving frequency gradually decreases per N scan lines, where N is an integer greater than 0.

5. The display device of claim 1, wherein the display device is a foldable display device, and wherein the boundary between the first partial panel region and the second partial panel region corresponds to a folding line of the foldable display device.

6. The display device of claim 1, wherein, when a moving image is displayed in a portion of the display panel, and a still image is displayed in another portion of the display panel, the first partial panel region is set as the portion of the display panel in which the moving image is displayed, the second partial panel region is set as the other portion of the display panel in which the still image is displayed, and the boundary between the first partial panel region and the second partial panel region is dynamically changed.

7. The display device of claim 1, wherein a portion of one of the first and second partial panel regions driven at a lower one of the first and second driving frequencies is set as the boundary portion.

8. The display device of claim 1, wherein a number of scan lines comprised in the boundary portion is set according to a boundary portion size parameter, and the third driving frequency for the boundary portion is set according to a boundary portion frequency parameter.

9. The display device of claim 1, wherein the third driving frequency for the boundary portion is set according to a boundary portion frequency parameter.

10. The display device of claim 1, wherein the panel driver comprises:

a still image detector to receive input image data at an input frame frequency, to divide the input image data into first partial image data for the first partial panel region and second partial image data for the second partial panel region, and to determine whether each of the first and second partial image data represent the still image.

11. The display device of claim 10, wherein the still image detector comprises:

a representative value memory to store a representative value of the first partial image data in a previous frame and a representative value of the second partial image data in the previous frame; and a still image detecting block to calculate a representative value of the first partial image data in a current frame and a representative value of the second partial image data in the current frame, to determine whether the first partial image data represent the still image by comparing the calculated representative value of the first partial image data and the representative value of the first partial image data stored in the representative value memory, and to determine whether the second partial image data represent the still image by comparing the calculated representative value of the second partial image data and the representative value of the second partial image data stored in the representative value memory.

12. The display device of claim 10, wherein the panel driver further comprises:

a driving frequency decider to determine the first driving frequency for the first partial panel region according to whether the first partial image data represent the still image, and to determine the second driving frequency for the second partial panel region according to whether the second partial image data represent the still image.

13. The display device of claim 12, wherein the driving frequency decider comprises:

a flicker lookup table to store flicker values corresponding to a plurality of gray levels of image data; and a driving frequency deciding block to set the first driving frequency at the input frame frequency when the first partial image data do not represent the still image, to decide a first flicker value corresponding to a gray level of the first partial image data by utilizing the flicker lookup table when the first partial image data represent the still image, to set the first driving frequency at a driving frequency corresponding to the first flicker value when the first partial image data represent the still image, to set the second driving frequency at the input frame frequency when the second partial image data do not represent the still image, to decide a second flicker value corresponding to a gray level of the second partial image data by utilizing the flicker lookup table when the second partial image data represent the still image, and to set the second driving frequency at a driving frequency corresponding to the second flicker value when the second partial image data represent the still image.

14. The display device of claim 12, wherein the panel driver further comprises:

a boundary portion setter to compare the first driving frequency and the second driving frequency, to set a portion of one of the first and second partial panel regions driven at a lower one of the first and second driving frequencies as the boundary portion, and to determine the third driving frequency for the boundary portion to be between the first driving frequency and the second driving frequency;

a data output unit to output the first partial image data and the second partial image data except for boundary image data for the boundary portion at the first driving frequency and the second driving frequency, respectively, and to output the boundary image data for the boundary portion at the third driving frequency; and a data driver to provide data signals to the display panel based on the first partial image data, the second partial image data and the boundary image data output from the data output unit.

15. The display device of claim 1, wherein the panel driver comprises:

a scan driver to provide scan signals to the first partial panel region at the first driving frequency, to provide scan signals to the second partial panel region at the second driving frequency, and to provide scan signals to the boundary portion at the third driving frequency.

16. The display device of claim 15, wherein the scan driver comprises:

a plurality of stages to generate scan signals at an input frame frequency for a plurality of scan lines comprised in the display panel; and a plurality of logic gates respectively connected to the plurality of stages, and to selectively output the scan signals generated by the plurality of stages in response to a scan output masking signal, respectively, such that the scan signals are provided to the first partial panel region, the second partial panel region and the boundary portion at the first driving frequency, the second driving frequency and the third driving frequency, respectively.

17. The display device of claim 1, wherein each of the plurality of pixels further comprises a storage capacitor to store the data signal transferred through the switching transistor and the diode-connected driving transistor;

a first initializing transistor to provide an initialization voltage to the storage capacitor and a gate electrode of the driving transistor;

a first emission controlling transistor to connect a line of a power supply voltage to a source electrode of the driving transistor;

a second emission controlling transistor to connect a drain electrode of the driving transistor to the organic light emitting diode; and a second initializing transistor to provide the initialization voltage to the organic light emitting diode, wherein at least one transistor selected from the driving transistor, the switching transistor, the compensating transistor, the first initializing transistor, the first emission controlling transistor, the second emission controlling transistor and the second initializing transistor is implemented with a PMOS transistor, and at least one transistor selected from a remaining one of the driving transistor, the switching transistor, the compensating transistor, the first initializing transistor, the first emission controlling transistor, the second emission controlling transistor and the second initializing transistor is implemented with an NMOS transistor.

18. A display device comprising:

a display panel comprising a first partial panel region and a second partial panel region; and a panel driver to drive the display panel, wherein the panel driver is to further determine a first driving frequency for the first partial panel region and a second driving frequency for the second partial panel region, wherein, when the first driving frequency and the second driving frequency are different from each other, the panel driver is to further set a boundary portion comprising a boundary between the first partial panel region and the second partial panel region, and to determine a third driving frequency for the boundary portion to be between the first driving frequency and the second driving frequency, wherein a boundary reference frequency is determined to be gradually decreased in a direction from one of the first and second partial panel regions driven at a higher one of the first and second driving frequencies to the other one of the first and second partial panel regions driven at a lower one of the first and second driving frequencies, wherein a line random frequency is determined randomly with respect to each of a plurality of scan lines comprised in the boundary portion, and wherein the third driving frequency is determined as a sum of the boundary reference frequency and the line random frequency.

19. A display device comprising:

a display panel including a plurality of partial panel regions; and a panel driver to drive the display panel, wherein the panel driver is to further determine a plurality of driving frequencies for the plurality of partial panel regions, respectively, wherein, when a first one of the plurality of driving frequencies for a first partial panel region of the plurality of partial panel regions is higher than a second one of the plurality of driving frequencies for a second partial panel region of the plurality of partial panel regions adjacent to the first partial panel region, the panel driver is to further set a boundary portion comprising a boundary between the first and second partial panel regions and to determine a driving frequency for the boundary portion to be between the driving frequencies for the first and second partial panel regions such that the driving frequency for the boundary portion is lower than the first one of the driving frequencies and is higher than the second one of the driving frequencies, wherein each of the plurality of partial panel regions comprises a plurality of pixels, and wherein each of the plurality of pixels comprises:

a driving transistor to generate a driving current;

a switching transistor to transfer a data signal to a source of the driving transistor;

a compensating transistor to diode-connect the driving transistor in response to a scan signal; and an organic light emitting diode to emit light based on the driving current, and wherein, when a still image is displayed in the second partial panel region, a frequency of the scan signal provided to each of the plurality of pixels in the second partial panel region is different from a frequency of the scan signal provided to each of the plurality of pixels in the first partial panel region;

wherein each of the plurality of pixels further comprises:

an initializing transistor to provide an initialization voltage to a gate electrode of the driving transistor in response to an initialization signal, and wherein, when the still image is displayed in the second partial panel region, a frequency of the initialization signal provided to each of the plurality of pixels in the second partial panel region is different from a frequency of the initialization signal provided to each of the plurality of pixels in the first partial panel region.

20. The display device of claim 19, wherein the driving frequency for the boundary portion gradually decreases in a direction from one of the first and second partial panel regions at a relatively higher driving frequency to the other one of the first and second partial panel regions at a relatively lower driving frequency.

* * * * *